US009068447B2

(12) United States Patent
Alvarez et al.

(10) Patent No.: US 9,068,447 B2
(45) Date of Patent: Jun. 30, 2015

(54) METHODS FOR STIMULATING MULTI-ZONE WELLS

(75) Inventors: Jose Oliverio Alvarez, Houston, TX (US); Michael T. Hecker, Tomball, TX (US); Ted A. Long, Spring, TX (US); Scott R. Clingman, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 255 days.

(21) Appl. No.: 13/700,973

(22) PCT Filed: Apr. 25, 2011

(86) PCT No.: PCT/US2011/033796

§ 371 (c)(1),
(2), (4) Date: Nov. 29, 2012

(87) PCT Pub. No.: WO2012/011993

PCT Pub. Date: Jan. 26, 2012

(65) Prior Publication Data

US 2013/0105159 A1 May 2, 2013

Related U.S. Application Data

(60) Provisional application No. 61/366,692, filed on Jul. 22, 2010.

(51) Int. Cl.

| | |
|---|---|
| ***E21B 33/13*** | (2006.01) |
| ***E21B 43/28*** | (2006.01) |
| ***E21B 29/02*** | (2006.01) |
| ***E21B 43/25*** | (2006.01) |
| ***E21B 33/12*** | (2006.01) |
| ***E21B 43/14*** | (2006.01) |
| ***E21B 43/26*** | (2006.01) |

(52) U.S. Cl.

CPC ..... *E21B 43/25* (2013.01); *E21B 29/02* (2013.01); *E21B 33/12* (2013.01); *E21B 43/14* (2013.01); *E21B 43/26* (2013.01)

(58) Field of Classification Search

CPC ..... E21B 33/13; E21B 43/261; E21B 43/283; E21B 43/28; E21B 29/02; E21B 33/134

See application file for complete search history.

(56) References Cited

U.S. PATENT DOCUMENTS

| | | | | |
|---|---|---|---|---|
| 2,368,428 | A | 1/1945 | Saurenman | |
| 3,289,762 | A | 12/1966 | Schell | |
| 3,371,171 | A | 2/1968 | Chenoweth | |
| 3,735,815 | A | 5/1973 | Myers | |
| 3,957,115 | A * | 5/1976 | Kerzee et al. | 166/297 |
| 4,898,242 | A * | 2/1990 | Jennings et al. | 166/285 |
| 5,398,763 | A | 3/1995 | Watson et al. | |
| 5,431,228 | A | 7/1995 | Weingarten et al. | |
| 5,607,017 | A | 3/1997 | Owens et al. | |
| 5,704,426 | A | 1/1998 | Rytlewski et al. | |
| 5,803,178 | A | 9/1998 | Cain | |
| 5,894,888 | A | 4/1999 | Wiemers et al. | |

(Continued)

*Primary Examiner* — Cathleen Hutchins

(74) *Attorney, Agent, or Firm* — ExxonMobil Upstream Research -Law Department

(57) ABSTRACT

A method for stimulating a multi-zone wellbore completed with a string of production casing, including pumping a first volume of acidic fluid into the wellbore under pressure, and then injecting the first volume of acidic fluid into a first zone of interest along the production casing dropping at least one plug into the wellbore, the plug being fabricated from a material that substantially dissolves in the presence of the acidic fluid at or over a selected period of time.

30 Claims, 22 Drawing Sheets

(56) References Cited

U.S. PATENT DOCUMENTS

| | | | |
|---|---|---|---|
| 6,047,773 | A | 4/2000 | Zeltmann et al. |
| 6,378,627 | B1 | 4/2002 | Tubel et al. |
| 6,394,184 | B2 | 5/2002 | Tolman et al. |
| 6,491,116 | B2 | 12/2002 | Berscheidt et al. |
| 6,497,284 | B2 | 12/2002 | van Petegem et al. |
| 6,520,255 | B2 | 2/2003 | Tolman et al. |
| 6,543,538 | B2 | 4/2003 | Tolman et al. |
| 6,575,247 | B2 | 6/2003 | Tolman et al. |
| 6,581,681 | B1 | 6/2003 | Zimmerman et al. |
| 6,672,405 | B2 | 1/2004 | Tolman et al. |
| 6,755,251 | B2 | 6/2004 | Thomas et al. |
| 6,843,317 | B2 | 1/2005 | Mackenzie |
| 6,915,856 | B2 | 7/2005 | Gentry et al. |
| 6,957,701 | B2 | 10/2005 | Tolman et al. |
| 7,059,407 | B2 | 6/2006 | Tolman et al. |
| 7,287,592 | B2 | 10/2007 | Surjaatmadja et al. |
| 7,287,596 | B2 | 10/2007 | Frazier et al. |
| 7,357,151 | B2 | 4/2008 | Lonnes |
| 7,363,967 | B2 | 4/2008 | Burris, II et al. |
| 7,380,600 | B2 | 6/2008 | Willberg et al. |
| 7,385,523 | B2 | 6/2008 | Thomeer et al. |
| 7,467,778 | B2 | 12/2008 | Lonnes |
| 7,516,792 | B2 | 4/2009 | Lonnes et al. |
| 7,699,101 | B2 | 4/2010 | Fripp et al. |
| 7,703,507 | B2 | 4/2010 | Strickland |
| 7,735,559 | B2 | 6/2010 | Malone |
| 7,814,970 | B2 | 10/2010 | Strickland |
| 8,029,026 | B2 | 10/2011 | Stolle et al. |
| 8,037,934 | B2 | 10/2011 | Strickland |
| 8,162,051 | B2 | 4/2012 | Strickland |
| 8,272,439 | B2 | 9/2012 | Strickland |
| 2005/0205264 | A1 | 9/2005 | Starr et al. |
| 2006/0124312 | A1* | 6/2006 | Rytlewski et al. ..... 166/313 |
| 2007/0044958 | A1* | 3/2007 | Rytlewski et al. ..... 166/250.01 |
| 2008/0060811 | A1 | 3/2008 | Bour et al. |
| 2008/0060820 | A1 | 3/2008 | Bour et al. |
| 2008/0066902 | A1 | 3/2008 | Bullard |
| 2008/0093073 | A1 | 4/2008 | Bustos et al. |
| 2008/0156498 | A1 | 7/2008 | Phi et al. |
| 2008/0257546 | A1 | 10/2008 | Cresswell et al. |
| 2008/0274918 | A1 | 11/2008 | Quintero et al. |
| 2008/0302538 | A1 | 12/2008 | Hofman |
| 2009/0114385 | A1 | 5/2009 | Lumbye |
| 2009/0294128 | A1 | 12/2009 | Dale et al. |
| 2010/0122813 | A1 | 5/2010 | Trummer et al. |
| 2010/0200230 | A1 | 8/2010 | East, Jr. et al. |
| 2011/0035152 | A1 | 2/2011 | Durocher et al. |
| 2011/0048122 | A1 | 3/2011 | Le Foll et al. |

* cited by examiner

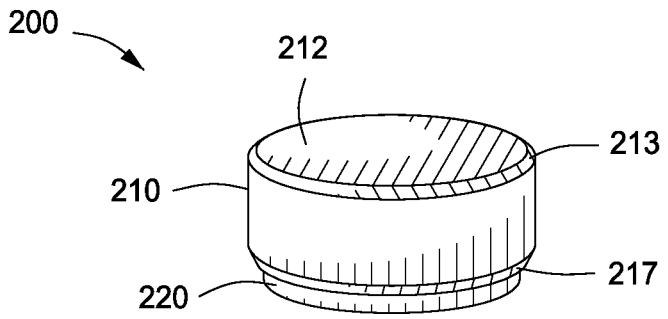
FIG. 2A
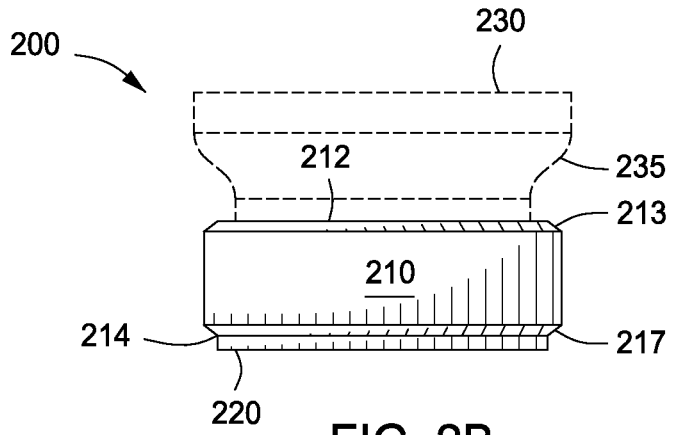
FIG. 2B
FIG. 4
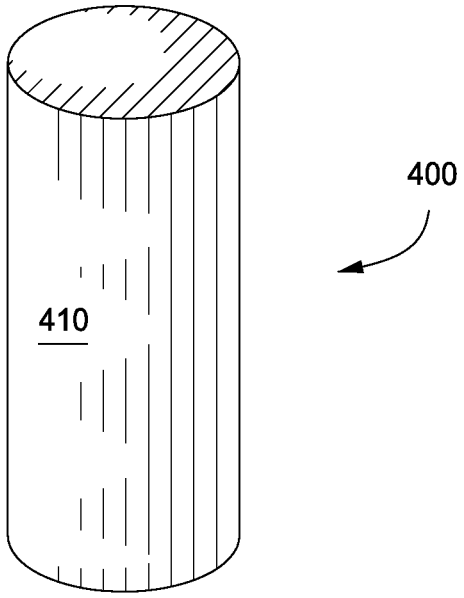

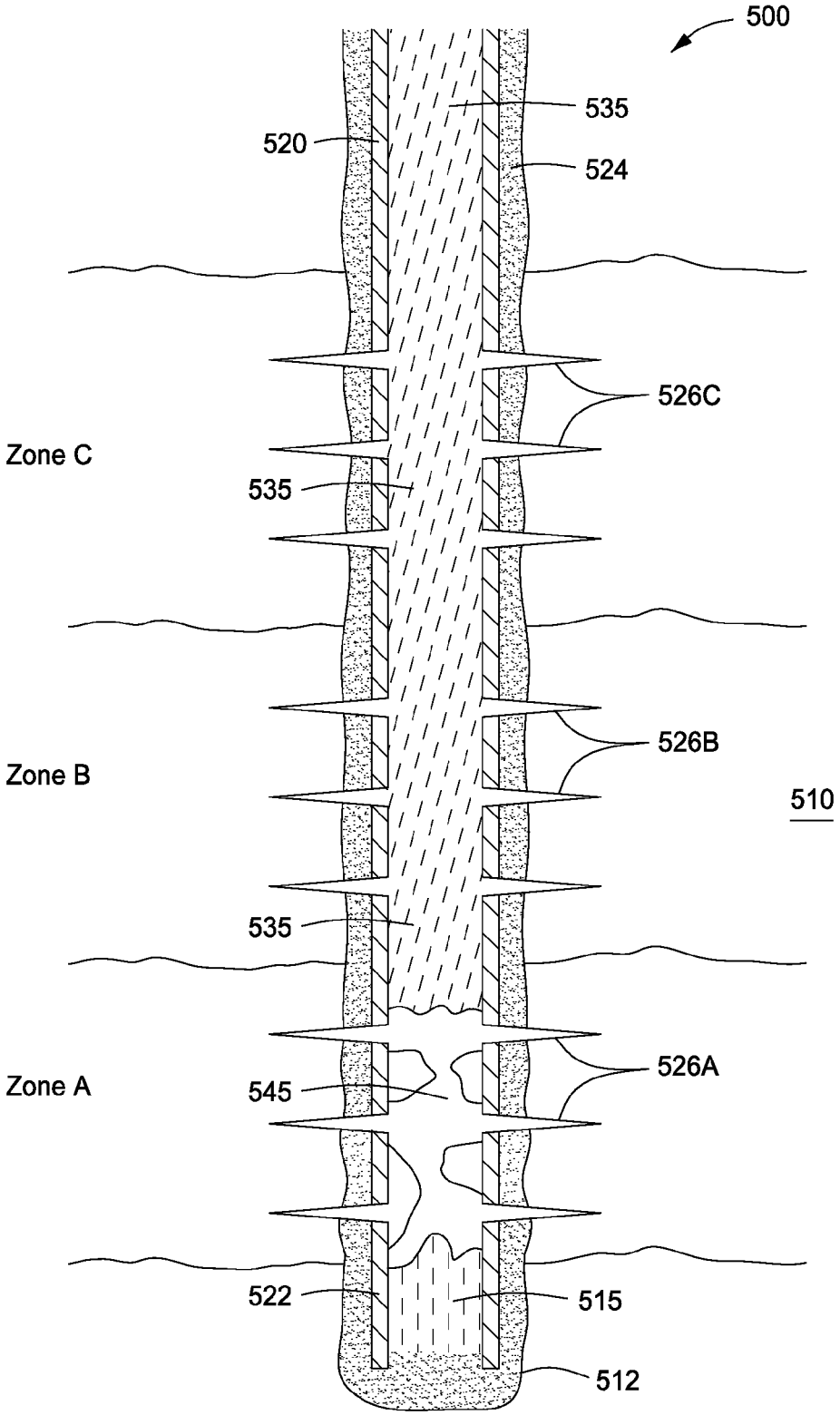
FIG. 5E (1)

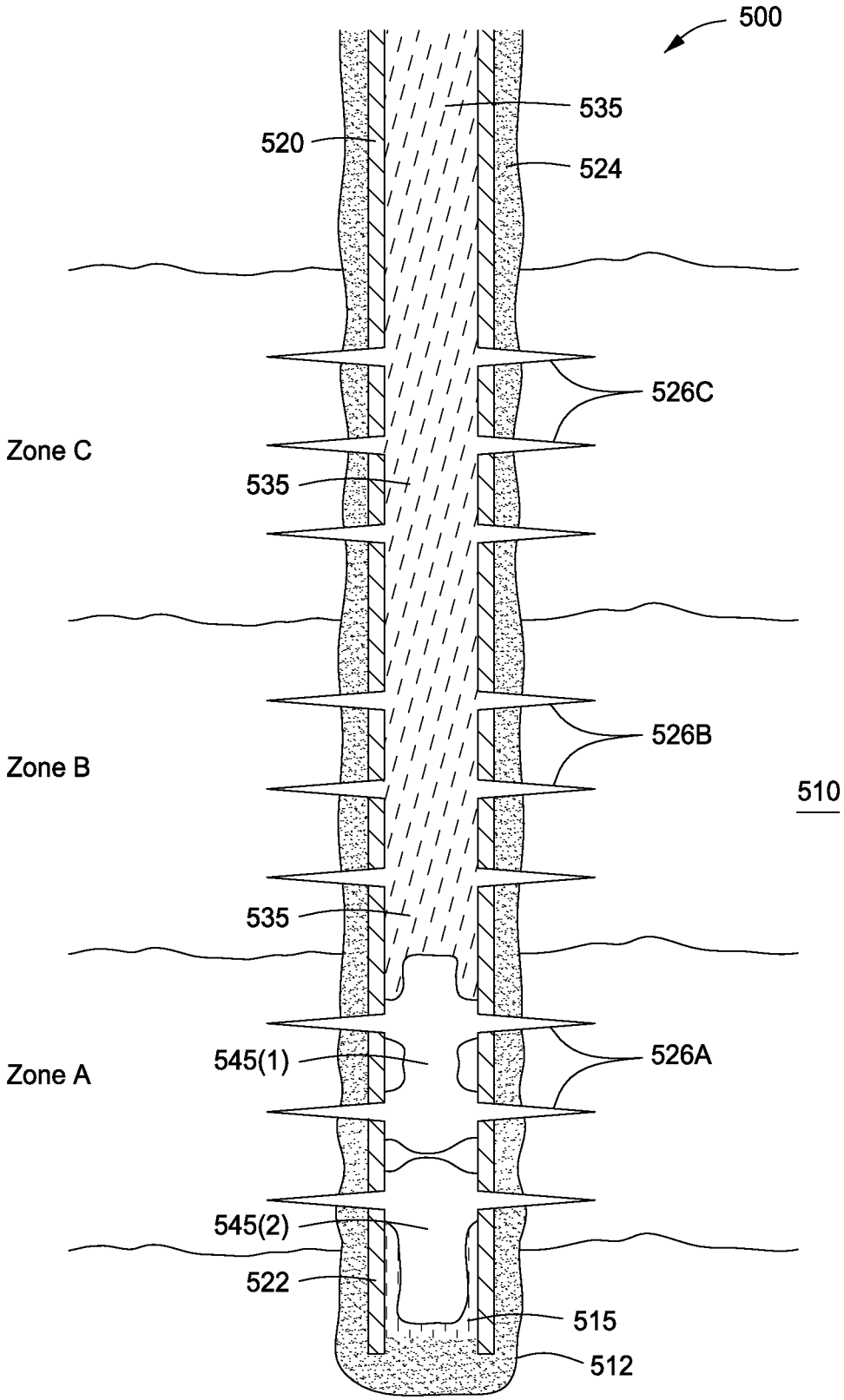
FIG. 5E (2)

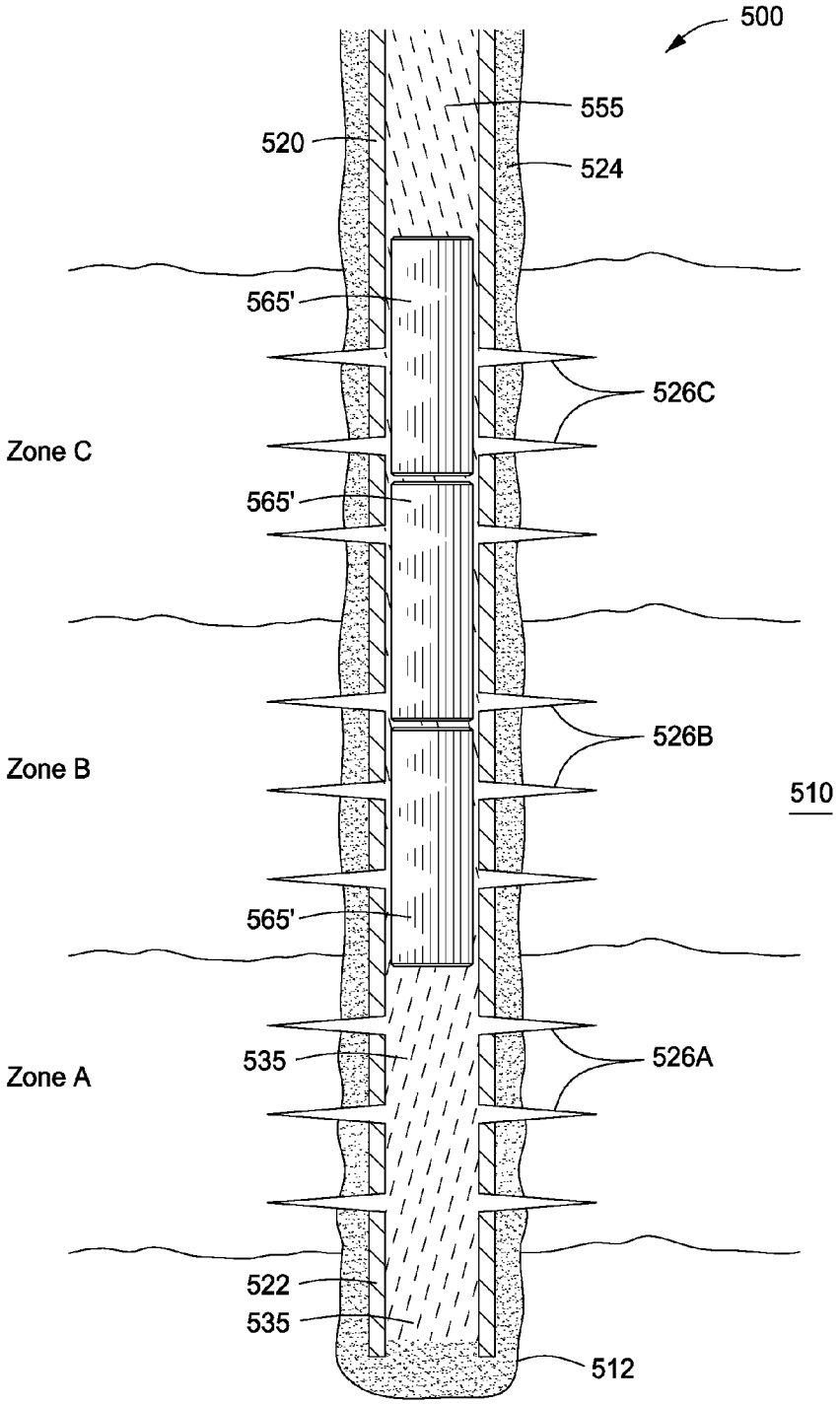
FIG. 5G (1)

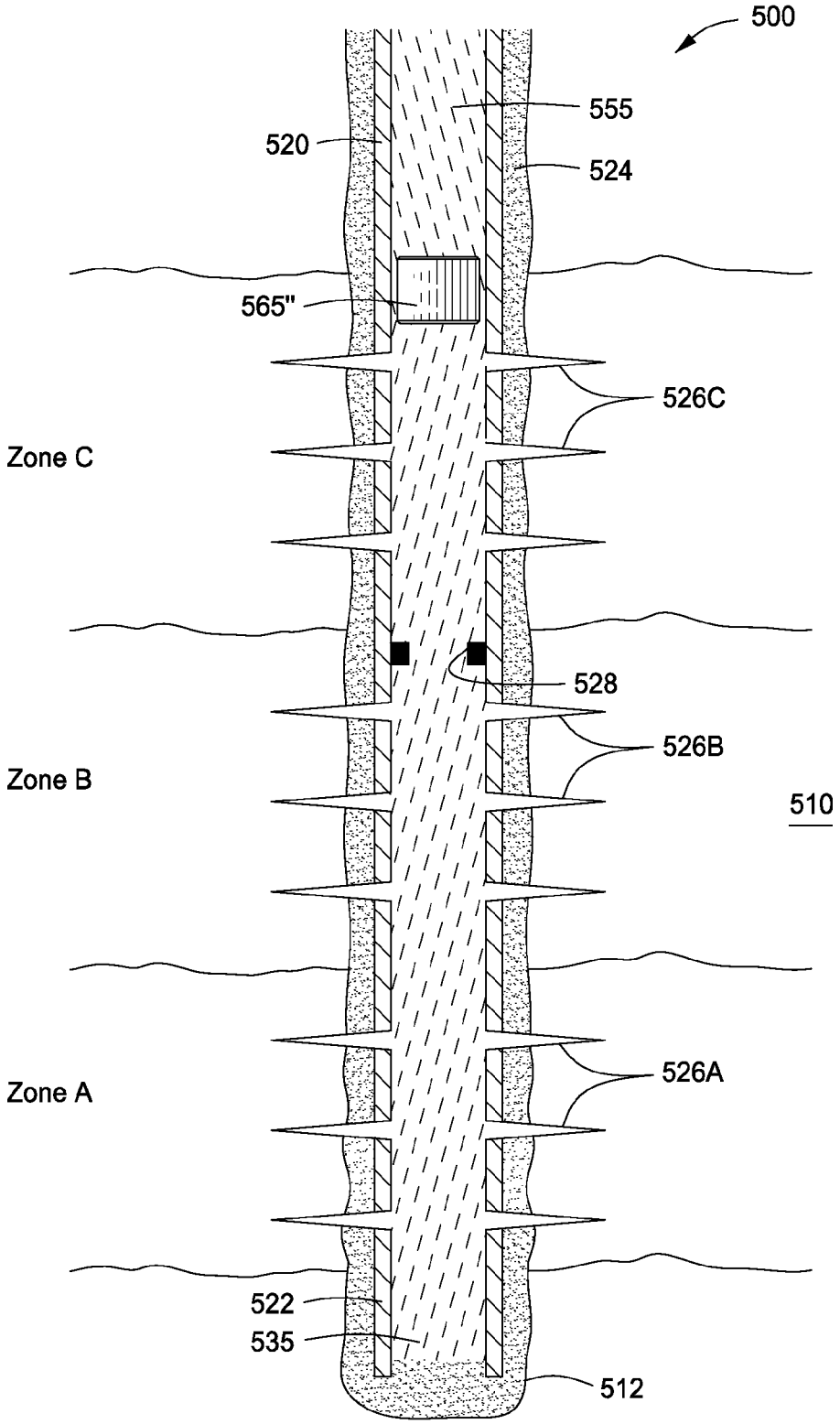
FIG. 5G (2)

METHODS FOR STIMULATING MULTI-ZONE WELLS

CROSS-REFERENCE TO RELATED APPLICATION

This application is the National Stage of International Application No. PCT/US2011/033796, filed 25 Apr. 2011, which claims the priority benefit of U.S. Provisional Patent Application 61/366,692 filed 22 Jul. 2010 entitled METHODS FOR STIMULATING MULTI-ZONE WELLS, the entirety of which is incorporated by reference herein.

FIELD OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

The present inventions relate to the completion of hydrocarbon-producing wells. More specifically, the inventions relate to acid stimulations for multi-zone wellbores.

BACKGROUND

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation.

A cementing operation is typically conducted in order to fill or "squeeze" the annular area with cement. This serves to form a cement sheath. The combination of cement and casing strengthens the wellbore and facilitates the isolation of the formations behind the casing.

It is common to place several strings of casing having progressively smaller outer diameters into the wellbore. Thus, the process of drilling and then cementing progressively smaller strings of casing is repeated several or even multiple times until the well has reached total depth. The final string of casing, referred to as a production casing, is cemented into place. In some instances, the final string of casing is a liner, that is, a string of casing that is not tied back to the surface, but is hung from the lower end of the preceding string of casing.

As part of the completion process, the production casing is perforated at a desired level. This means that lateral holes are shot through the casing and the cement sheath surrounding the casing to allow hydrocarbon fluids to flow into the wellbore. Thereafter, the formation is stimulated either by hydraulic fracturing (injecting fluid under high pressure through the perforations in order to create flow-channels in the formation) or by acid stimulation (circulating an acidic solution through the wellbore).

As an additional step in the wellbore completion process, production equipment such as tubing, packers and pumps may be installed within the wellbore. A wellhead (or "tree") is installed at the surface along with fluid gathering and processing equipment. Production operations may then commence.

Before beginning production, it is sometimes desirable for the drilling company to "stimulate" the formation by injecting an acid solution through the perforations. This is particularly true when the formation comprises carbonate rock. Injection of the acid stimulation fluid creates channels called "wormholes."

In operation, the drilling company injects a concentrated formic acid or other acidic composition into the wellbore, and directs the fluid into the subsurface formation. This is known as acidizing. The acid helps to dissolve carbonate material, thereby opening up porous channels through which hydrocarbon fluids may flow into the wellbore. In addition, the acid helps to dissolve drilling mud that may have invaded the formation. Application of hydraulic fracturing and acid stimulation as described above is a routine part of petroleum industry operations.

In many wellbores, it is now common to complete a well through multiple zones of interest. Such zones may represent up to about 30 meters (about 100 feet) of gross, vertical thickness of subterranean formation. When there are multiple or layered reservoirs to be hydraulically fractured, or a very thick hydrocarbon-bearing formation, then more complex treatment techniques are required to obtain treatment of each of the target zones. In this respect, the drilling company must isolate various zones to ensure that each separate zone is not only perforated, but adequately stimulated (fractured and/or acidized). In this way the operator is sure that stimulant is being injected through each set of perforations and into each zone of interest to effectively increase the flow capacity at each desired depth.

This same issue may arise when an operator desires to stimulate a well after a period of production. In this respect, the operator may desire to perform acid stimulation in multiple pay zones. However, because the wellbore has multiple sets of perforations, it is desirable to direct the acidizing solution into each separate zone of interest while sealing off lower zones of interest.

To do this, various fluid diversion techniques may be employed. Two general categories of fluid diversion have been developed to help ensure that the acid reaches the desired rock matrix—mechanical and chemical. Mechanical diversion involves the use of a physical or mechanical diverter that is placed within the wellbore. Chemical diversion, on the other hand, involves the injection of a fluid or particles into the wellbore.

Referring first to chemical diverters, chemical diverters include foams, particulates, gels, and viscosified fluids. Foam commonly comprises a dispersion of gas and liquid wherein a gas is in a non-continuous phase and liquid is in a continuous phase. Where acid is used as the liquid phase, the mixture is referred to as a foamed acid. In either event, as the foam mixture is pumped downhole and into the porous medium that comprises the original, more permeable formation, additional foam is generated. The foam initially builds up in the areas of high permeability until it provides enough resistance to force the acid into the new zone of interest having a lower permeability. The acid is then able to open up pores and channels in the new formation.

Particulate diverters consist of fine particles. Examples of known particulate diverters are cellophane flakes, oyster shells, crushed limestone, gilsonite, oil-soluble naphthalenes, and even chicken feed. Within the last several years, solid organic acids such as lactic acid flakes have been used. As the particles are injected, they form a low permeability filter-cake on the face of wormholes and other areas of high permeability in a lower formation. This then forces acid treatment to enter upper zone(s) of interest. After the acidizing treatment is completed, the particulates hydrolyze in the presence of water and are converted into acid.

Viscous diverters are highly viscous materials, sometimes referred to as gels. Gels use either a polymer or a viscoelastic surfactant (VES) to provide the needed viscosity. Polymer-based diverters crosslink to form a viscous network upon reaction with the formation. The crosslink breaks upon continued reaction and/or with an internal breaker. VES-based diverters increase viscosity by a change in micelle structure upon reaction with the formation. As the high-viscosity material is injected into the formation, it fills existing wormholes. This allows acid to be injected into areas of lower permeability higher in the wellbore. The viscosity of the gel breaks upon exposure to hydrocarbons (on flowback) or upon contact with a solvent.

Referring now to mechanical diverters, various types of mechanical diverters have been employed. These generally include ball sealers, plugs, and straddle packers. For example, U.S. Pat. No. 3,289,762 uses a ball that seats in a baffle to cause mechanical isolation. U.S. Pat. No. 5,398,763 uses a wireline to set and then to retrieve a baffle. The baffle isolates a portion of a formation for the injection of fluids. U.S. Pat. No. 6,491,116 provides a fracturing plug, or "frac plug." Frac plugs are common in the industry and rely upon a ball that is either dropped from the surface to land on a seat, or that is integral to the plug itself. Frac plugs generally require a wireline for setting. Frac plugs may also be retrieved via wireline, although in some instances frac plugs have been fabricated from materials that can be drilled out. Drilling out the material adds time and expense to the stimulation operation.

Mechanical plugs are used to isolate an interval after successfully stimulating a lower zone. Although the stimulation of each zone separately can be very effective, multiple electric line runs and acid stimulations may be required to fully stimulate a long interval, increasing the time and cost of the acid treatment. Further, while mechanical plugs can provide high confidence that formation treatment fluid is being diverted, there is a risk of incurring high costs due to mechanical and operational complexity of the plugs. Plugs may become stuck in the casing resulting in a lengthy and costly fishing operation. If fishing is unsuccessful, a drilling rig may be needed to be brought on-sight to drill the plug out. Drilling out the plug is not preferred due to the time and cost associated with mobilizing a drilling rig on location. In some situations, the well may have to be sidetracked or even abandoned. Mechanical plugs particularly have a history of reliability issues in large diameter wells. In this respect, it can be difficult to locate a plug suitable for a large borehole, and those that are available have a history of failures.

A need exists for an improved mechanical plug that carries the benefits of a chemical diverter, that is, it can never become permanently stuck in the wellbore. This removes the possibility of failure and subsequent fishing operations. A need further exists for a dissolvable plug that nevertheless improves the stimulation of upper zones in a multi-zone wellbore. In this way, each zone in a multi-zone wellbore enjoys a successful acid stimulation job, that is, all zones receive the desired amount of acid, at low cost.

SUMMARY

A method for stimulating a multi-zone wellbore is provided. In the method, the wellbore is completed with a string of production casing. The production casing may be joints of casing cemented into the wellbore along various subsurface zones. Alternatively, the production casing may be a liner string that is either hung or expanded into place from a next higher casing string. The liner may or may not have packers. In any case, the wellbore is completed through multiple zones of interest.

The method generally includes pumping a first volume of acidic fluid into the wellbore under pressure. The acidic fluid may be, for example, an acid solution containing about 15% or more, hydrochloric acid. The current methods are not limited by the nature of the acidic composition.

The method also includes injecting the first volume of acidic fluid so as to inject the first volume of acidic fluid into a first zone of interest along the production casing, typically a lower zone.

The method also includes dropping a plug into the wellbore. The term "dropping" is intended to mean any method for delivering or releasing a plug into a wellbore. The plug has a defined geometry such that it can be transported and handled. Preferably, the plug has a cylindrical profile, although it may alternatively be conical, semi-spherical, or other shape. The plug is fabricated from a material that substantially dissolves in the presence of the acidic fluid over a selected period of time. For example, the plug may be made of carbonate material that may not substantially dissolve for about 5 minutes to about 45 minutes. Optionally, a polymeric or elastomeric coating is placed around the second plug to inhibit dissolution of the plug material. For example, the coating may delay the commencement of dissolution for about 5 to 15 minutes. Also, the plug may have an elastomeric extension to facilitate the passage of the plug through wellbore restrictions.

The plug may be a relatively short, rigid plug. In this instance, the plug will land on a seat above the first zone of interest. Alternatively, the plug may be a long, viscous plug having a gelatinous composition. In this instance, the plug will rest on the bottom of the wellbore and extend across the first zone of interest to substantially seal perforations along the first zone of interest. Alternatively, the viscous plug will break up under pumping pressure and temporarily plug the perforations along the first zone of interest. In any instance, the plug is set along the production casing to inhibit the flow of a second volume of acidic fluid into the first zone of interest.

The method also includes injecting a second volume of acidic fluid into the wellbore under pressure. The second volume of acidic fluid pushes the plug down the wellbore. The plug eventually sets at or above the first zone of interest. The plug thus serves as a diversion mechanism to substantially prevent acidic fluids from being pumped down to the first zone of interest.

The method then includes pumping the second volume of acidic fluid into a second zone of interest along the production casing. The second zone of interest is above the first zone of interest, meaning that it has a lower measured depth. The second volume of acidic fluid is diverted into the second zone of interest by the plug, and before the plug dissolves. In one aspect, the second plug actually defines two or more cylindrical plugs that are stacked one on top of the other within the production casing in order to cover perforations along the first zone of interest. Using two or more stacked plugs may also increase the plugging capability of the plug.

The method may be extended analogously to a third zone of interest. This can be done by dropping one or more plugs before a third volume of acidic fluid is injected. The one or more plugs represent a subsequent plug, and will stack one on top of the other until extending at least partially above the second zone of interest and below a third zone of interest. The third volume of acidic fluid is then injected into the third zone of interest.

As an alternative, a seat may be placed along the production casing below the second or third zones of interest. The subsequent plug will land on the seat to temporarily prevent the injection of fluid into the wellbore below the third zone of interest. It is preferable that the subsequent plug be a single rigid plug that lands on a seat above the second zone of interest.

In one aspect, the method also includes dropping a previous plug into the wellbore. This is done before injecting the first volume of acidic fluid into the wellbore. The previous plug is also fabricated from a material that dissolves in the presence of the acidic fluid over a selected period of time. The previous plug serves to separate the first volume of acidic fluid from wellbore fluids already residing in the wellbore. The wellbore fluids are pushed back into the formation at the various zones of interest as the first volume of acidic fluid is pumped into the wellbore.

The previous plug will be pushed below the first zone of interest. In this way, the first volume of acidic fluid may enter the first zone of interest for acidic treatment.

A separate method for stimulating a multi-zone wellbore is provided herein. The wellbore has been completed with a string of production casing in a substantially vertical orientation. The method comprises pumping a first volume of acidic fluid into the wellbore. The method then includes dropping a fluid diversion plug into the wellbore. The fluid diversion plug has a defined geometry, and is fabricated from a material that dissolves in the presence of the first volume of acidic fluid over a selected period of time.

The method also includes pumping a second volume of acidic fluid into the wellbore. As the second volume is pumped downhole, the second volume pushes the fluid diversion plug down the wellbore. This causes at least a portion of the first volume of acidic fluid to travel into a first zone of interest along the production casing.

The method further includes setting the fluid diversion plug along the production casing. The fluid diversion plug is set above the first zone of interest to inhibit the flow of the second volume of acidic fluid into the first zone of interest. The method then includes injecting at least a portion of the second volume of acidic fluid into a second zone of interest along the production casing and above the diversion plug. This takes place before the fluid diversion plug substantially dissolves.

The method also includes dropping a fluid displacement plug into the wellbore. The fluid displacement plug also has a defined geometry, and is fabricated from a material that dissolves in the presence of the second volume of acidic fluid over the selected period of time. Thereafter, a third volume of acidic fluid is pumped into the wellbore. This acts to push the fluid displacement plug down the wellbore and to at least partially inject the second volume of acidic fluid into a second zone of interest above the first zone of interest. The method then includes setting the fluid displacement plug along the production casing above the second zone of interest. This inhibits the flow of the third volume of acidic fluid into the second zone of interest.

In one aspect of the method, the fluid displacement plug comprises at least one substantially solid body. Setting the fluid displacement plug along the production casing then comprises landing the fluid displacement plug on a seat within the production casing above the second zone of interest. In another aspect, the fluid displacement plug comprises at least one elongated gelatinous plug. Setting the fluid displacement plug along the production casing then comprises landing the at least one elongated gelatinous plugs on a bottom of the wellbore.

The method further comprises injecting at least a portion of the third volume of acidic fluid into the third zone of interest above the second zone of interest. This is done before the fluid displacement plug substantially dissolves.

In this method, each of the volumes of acidic fluid may comprise hydrochloric acid, acetic acid, formic acid, or combinations thereof. However, the method is not limited by the specific acidic fluid composition unless expressly stated in a claim.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 2A is a perspective view of a plug of the present invention, in one embodiment. Here, the plug is a substantially solid device.

FIG. 2B is side view of the plug of FIG. 2A. An optional upper centralizing member is shown added to the plug, in phantom.

FIG. 4 is a perspective view of a viscous plug as may be used in the methods of the present invention, in one embodiment. Here, the viscous plug is a cylindrical, gelatinous body.

FIG. 5E(1) is yet another side view of the wellbore of FIG. 5A. Here, the second viscous plug has set in the production casing below zone of interest "B" by breaking up into the perforations along zone of interest "A." The second volume of acidizing fluid is being injected into the zones of interest "B" and "C."

FIG. 5E(2) is an alternate arrangement of the wellbore of FIG. 5A. Here, the second plug actually comprises two or more plugs stacked from the bottom of the wellbore to temporarily cover the perforations along the zone of interest "A." The second volume of acidizing fluid is again being injected into the zone of interest "B".

FIG. 5G(1) is still another side view of the wellbore of FIG. 5A. Here, a third plug has been dropped into the wellbore. The third plug is actually a stack of viscous or solid plugs. The stack of plugs is being injected ahead of a third volume of acidizing fluid.

FIG. 5G(2) is an alternate side view of the wellbore of FIG. 5A. Here, a third plug is again being injected into the wellbore. However, the illustrative third plug is a rigid plug that is dimensioned to land on a seat along an inner diameter of the wellbore.

DETAILED DESCRIPTION

Definitions

Figure 1:
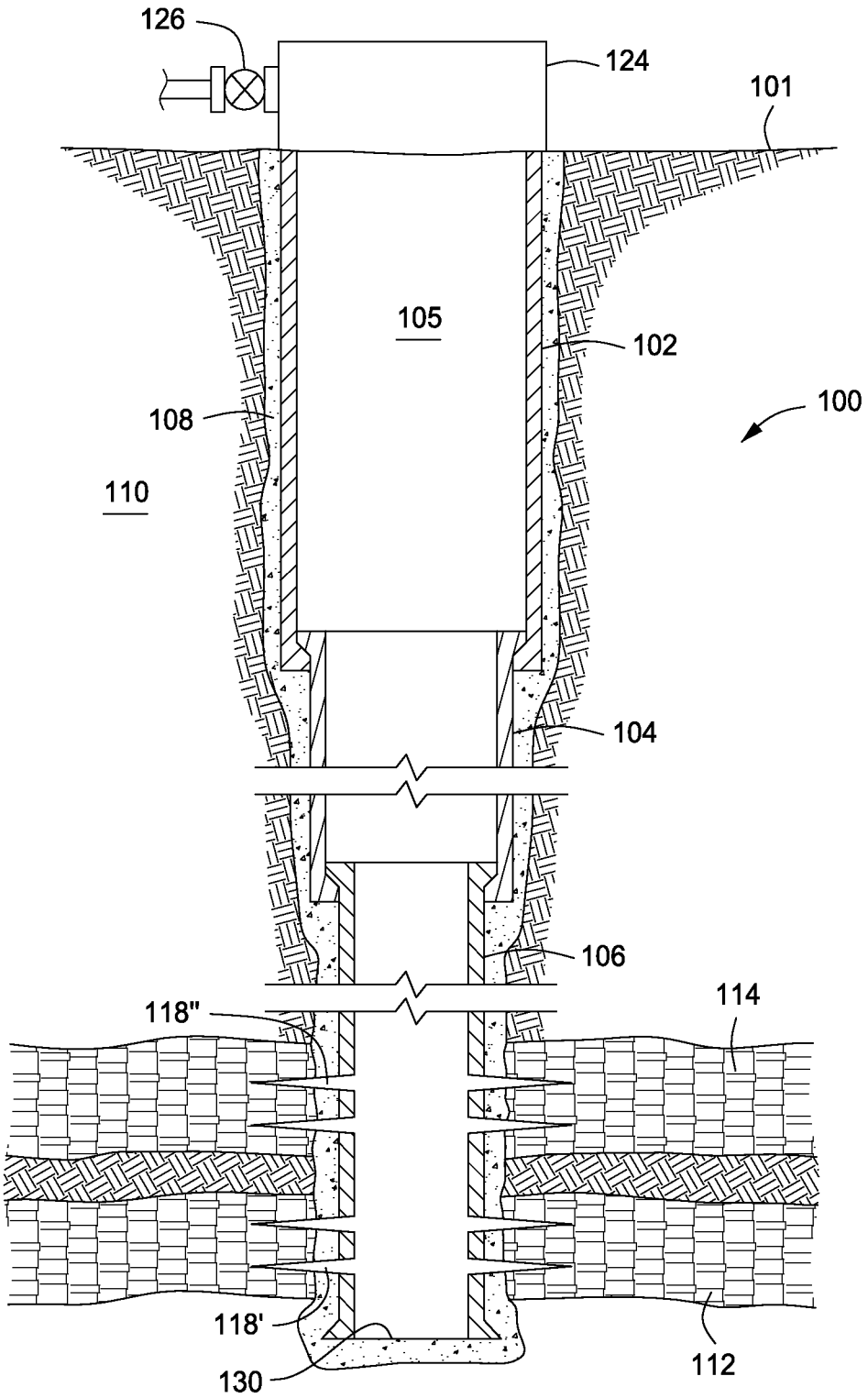
FIG. 1 is a cross-sectional view of an illustrative wellbore. The wellbore has been drilled through two different formations, each formation containing hydrocarbon fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring, hydrocarbons including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids.

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

The terms "zone" or "zone of interest" refers to a portion of a formation containing hydrocarbons.

As used herein, the term "formation" refers to any definable subsurface region. The formation may contain one or more hydrocarbon-containing layers, one or more non-hydrocarbon containing layers, an overburden, and/or an underburden of any geologic formation.

As used herein, the term "wellbore" refers to a hole in the subsurface made by drilling or insertion of a conduit into the subsurface. A wellbore may have a substantially circular cross section, or other cross-sectional shapes. As used herein, the term "well", when referring to an opening in the formation, may be used interchangeably with the term "wellbore."

For purposes of the present patent, the term "production casing" includes a liner string or any other tubular body fixed in a wellbore along a zone of interest.

Description Of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

FIG. 1 is a cross-sectional view of an illustrative wellbore 100. The wellbore 100 defines a bore 105 that extends from a surface 101, and into the earth's subsurface 110. The wellbore 100 includes a wellhead shown schematically at 124. The wellbore 100 further includes a shut-in valve 126. The shut-in valve 126 controls the flow of production fluids from the wellbore 100.

The wellbore 100 has been completed by setting a series of pipes into the subsurface 110. These pipes include a first string of casing 102, sometimes known as surface casing or a conductor. These pipes also include a final string of casing 106, known as a production casing. The pipes also include one or more sets of intermediate casing 104. The present inventions are not limited to the type of completion casing used. Typically, each string of casing 102, 104, 106 is set in place through cement 108. In some instances, the production casing may be a liner set using a liner hanger or an expandable joint.

In the illustrative arrangement of FIG. 1, the wellbore 100 is drilled through two different formations 112, 114. Each formation 112, 114 contains hydrocarbon fluids that are sought to be produced through the bore 105 and to the surface 101. In practice, the lower formation 112 is typically produced first. This is accomplished by shooting a first set of perforations 118' through the production casing 106 and the surrounding cement 108. After a period of time, the upper formation 114 is produced. This is accomplished by shooting a second set of perforations 118" through the production casing 106 and the surrounding cement 108.

In one aspect, the lower formation 112 is produced through the first set of perforations 118' for a period of time. Optionally, the second set of perforations 118" is not shot until production within the lower formation 112 begins to taper off. Either way, it is desirable to stimulate the upper formation 114 before production from the upper formation 114 commences. Alternatively, once production has taken place from each of the lower 112 and upper 114 formations over a period of time, it may be desirable to stimulate the formations 112, 114 to increase hydrocarbon production levels.

To do so, the present disclosure offers an improved diversion plug, and improved methods for diverting fluids in a wellbore. FIGS. 2A and 2B demonstrate an illustrative diversion plug 200, in one embodiment. FIG. 2A shows the plug 200 in perspective view, while FIG. 2B provides a side view. FIGS. 2A and 2B will be discussed together.

The diverting plug 200 first comprises a body 210. In the illustrative arrangement of FIGS. 2A and 2B, the body 210 is shaped as a cylindrical disc. However, other plug shapes may be used, such as domes (semi-spheres) and cones. Domes and cones potentially enhance the strength of the diverting plug 200 once it is seated along production casing.

The plug 200 has an upper end 212 and a bottom end 214. In the arrangement of FIGS. 2A and 2B, the upper end 212 tapers to a flat surface. Optionally, the upper end 212 includes a small hook (not shown) for releasably connecting to a wireline 318 (see FIG. 3B). At the same time, the bottom end 214 tapers to a stepped surface 220. The optional stepped surface 220 creates a small lower centralizing member to help stabilize the plug 200 after it is landed on the seat (shown in FIG. 3D, discussed below).

The bottom end 214 of the plug 210 includes an optional beveled edge 217. In one aspect, the beveled edge 217 of the plug 200 matches a beveled edge milled into an inner diameter of the seat (not shown). This too helps to strengthen the plug 200 against the hydraulic pressures exerted during a wellbore stimulation operation.

Another optional feature for the plug 200 is the addition of an upper and/or lower centralizing member. An upper centralizing member is shown in phantom lines at 230 in FIG. 2B. The upper centralizing member 230 helps keep the plug 230 straight within the bore of the production casing as the plug 200 is pumped downhole. The upper centralizing member 230 also helps keep fluid from bypassing the plug 200 during pump-in, and later helps with fluid diversion when fluid is pumped into a selected zone of interest.

The upper centralizing member 230 has a diameter that closely matches that of a surrounding production casing (such as casing 330). The upper centralizing member 230 is fabricated from a compliant material, such as butadiene rubber. This helps the plug 200 pass through restrictions in the production casing.

The illustrative centralizing member 230 of FIG. 2B includes a concave portion 235. The concave portion 235 helps create a seal between the centralizing member 230 and the surrounding production casing during pump-in. In this respect, hydrostatic head and pumping pressure cause the concave portion 235 to expand outwardly against the production casing, preventing a bypass of fluids around the centralizing member 230 and around the plug 200.

The upper end 212 of the plug 200 may also include a beveled edge 213. When the optional lower centralizing member (stepped surface 220) or upper centralizing member 230 are both not used, such an arrangement allows the plug 200 to be placed into a wellbore without regard to which end is the top end 212 and which end is the bottom end 214. In other words, the plug 200 becomes symmetrical.

It is understood that the geometry of the plug 200 is a matter of designer's choice. For example, the operator may prefer to have a plug with a body having a diameter that is smaller than a diameter of the centralizing member 230. As another example, the operator may prefer to have a plug with a centralizing member placed on both the upper and lower portions of the plug body 210. This arrangement is beneficial in that as the plug 200 is being pumped into the wellbore, the upper centralizing member 230 may begin to dissolve. However, the bottom centralizing member may remain intact, preventing fluid bypass around the plug 200.

What is important is that the diverting plug 200 be dimensioned to be launched into a wellbore as part of a well stimulation procedure. In addition, and in accordance with the present inventions, the plug 200 is fabricated from a material that will dissolve in the wellbore after a selected period of time. In this way, there is no risk of the plug 200 becoming permanently stuck in the wellbore.

To provide for this, the plug 200 is fabricated from a material that reacts with fluids. Where the plug 200 is used as part of a multi-zone acidization procedure, the plug 200 will be fabricated from a material that dissolves in the presence of acid. An example of such an acid is an acidic fluid comprised of about 15% to 50% hydrochloric acid or formic acid. Where the plug 200 is used as part of a fracturing procedure, the plug 200 is fabricated from a material that dissolves in the presence of brine. Examples of suitable material include sodium bicarbonate, calcite rock, chalk rock, or combinations thereof.

Preferably, the material that dissolves in the presence of fluid will begin to dissolve in about 1 minute to 30 minutes. More preferably, the material will begin to dissolve in about 5 minutes to 15 minutes. In addition, it is desirable that the material forming the plug 200 have a density that is greater than the fluid that is pushing it in the wellbore. In this way, the plug 200 can more easily move downward through the production casing in response to hydrostatic pressure and pumping.

Where the plug 200 has the upper centralizing member 230, it is desirable that the upper centralizing member 230 be fabricated from a material that will not dissolve in the presence of fluids as quickly as the body 210. For example, the upper centralizing member 230 may be fabricated from acid reactive polymers or elastomers. Non-limiting examples include polyester, polycarbonates, polylactic acid, nylon, cellulose, starch, acrylonitrile, polyurethane, and polyacrylate.

Alternatively or in addition, an outer layer may be provided over the plug body 210 to delay the reaction with the acidic fluid and the dissolving of the plug 230 in the wellbore. Again, examples of suitable materials are polyester, polycarbonates, polylactic acid, nylon, cellulose, starch, acrylonitrile, polyurethane, and polyacrylate. Alternatively, the outer layer may be fabricated from water-soluble materials such as a water soluble hardened gel. Examples of a water-soluble hardened gel include pullulan, hypromellose, and gelatin. The dimensions, density, shape and amount of material will depend on the operational needs.

Figure 3A:
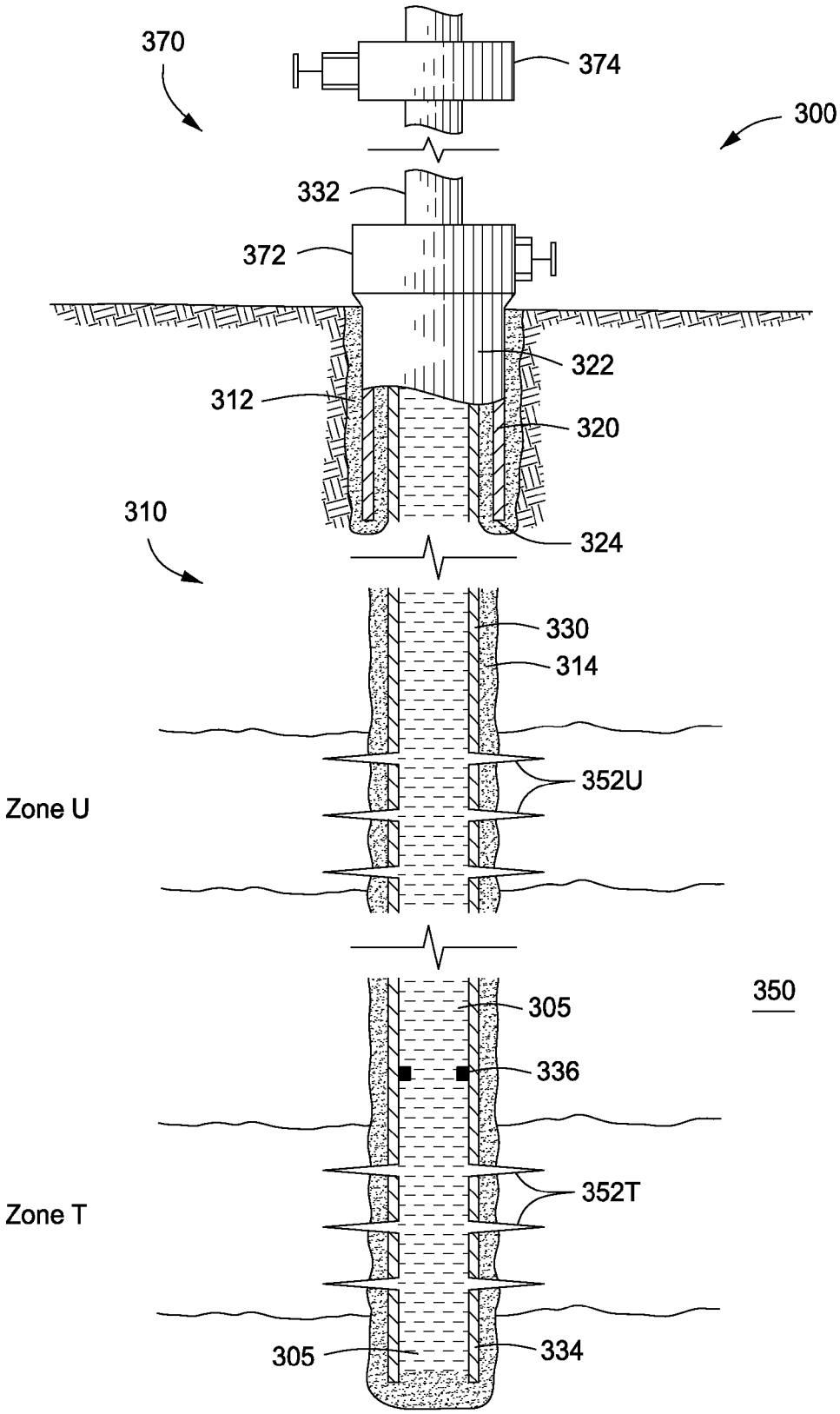
FIG. 3A is a side view of a well site having a wellbore for receiving a reactive plug. The wellbore has been completed in at least two zones of interest, to wit, zones "T" and "U." The wellbore has production fluids therein.

FIGS. 3A through 3G demonstrate the use of the reactive plug 200 in an illustrative wellbore. First, FIG. 3A presents a side view of a well site 300. The well site 300 includes a wellhead 370 and a wellbore 310 for receiving the plug 200. The wellbore 310 is generally in accordance with wellbore 10 of FIG. 1; however, it is shown in FIG. 3A that the wellbore 310 is being completed in a subsurface formation 350 through at least zones of interest "T" and "U."

The wellbore 310 is first formed with a string of surface casing 320. The surface casing 320 has an upper end 322 in sealed connection with a lower master valve 372. The surface casing 320 also has a lower end 324. The surface casing 320 is secured in the formation 350 with a surrounding cement sheath 312.

The wellbore 310 also includes a string of production casing 330. The production casing 330 is also secured in the formation 350 with a surrounding cement sheath 314. The production casing 330 has an upper end 332 in sealed connection with an upper master fracture valve 374. The production casing 330 also has a lower end 334. The production casing 330 extends through a lowest zone of interest "T," and also through at least one higher zone of interest "U" above the zone "T." A wellbore operation will be conducted that includes acidizing each of zones "T" and "U" sequentially.

It can be seen that the production casing 330 has been perforated along each of the zones "T" and "U". Perforations and accompanying formation fractures are shown at 352T and 352U, respectively. Note that zone "U" may be already perforated, or can be perforated after zone "T" is acidized.

Zones "T" and "U" may only be a short distance apart, such as only 10 feet or only 20 feet apart. Alternatively, zones "T" and "U" may be a considerable distance apart, such as 30 feet or even 100 feet apart. A break is shown in the production casing 330 to indicate that the distance may vary. In addition, the break indicates that additional zones of interest may optionally exist between zones "T" and "U."

A wellhead 370 is positioned above the wellbore 310. The wellhead 370 includes the lower 372 and upper 374 master fracture valves. The wellhead 370 may also include blow-out preventers (not shown). In addition, trucks having tanks and pumps (not shown) are typically used to inject and circulate treating fluids such as acid.

In the view of FIG. 3A, the production casing 330 is filled with wellbore fluids. The wellbore fluids are indicated at 305. Where the well site 300 is undergoing completion, the wellbore fluids 305 may represent a combination of drilling mud, formation fluids, and hydraulic fluids used in connection with perforating and fracturing the zones of interest "T" and "U." Where the well site 300 has been in production and the formation 350 is now undergoing remediation, the wellbore fluids 305 represent fluids that have been produced from the zones of interest "T" and "U." In any event, the wellbore fluids 305 will be temporarily pushed back into the formation 350 as part of an acidizing operation.

The production casing 330 has a seat 336. The seat 336 is placed along the inner diameter of the production casing 330 above the lowest zone of interest "T." The seat 336 may define a shoulder milled into the wall of the production casing 330. In this instance, the seat 336 represents a reduced inner diameter portion. Such a reduced inner diameter portion may be only a few centimeters in length, or may extend along the length of the production casing 330 to the lower end 334. Alternatively, the seat 336 may be a baffle remaining from an earlier perforating operation. The present methods are not limited by the type of seat provided, so long as it provides a restriction to the downward travel of a solid plug.

Figure 3B:
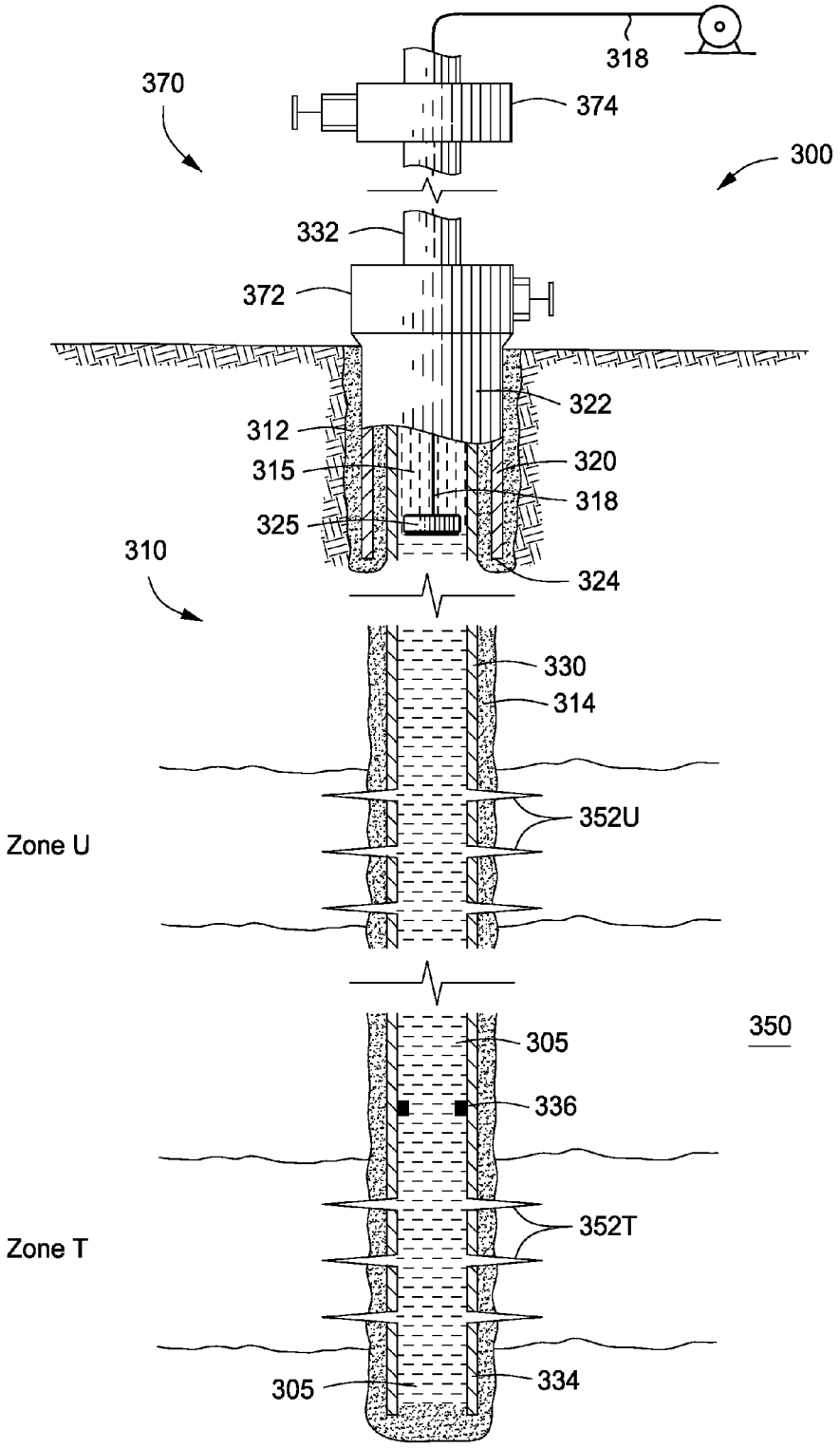
FIG. 3B is another side view of the well site of FIG. 3A. Here, the wellbore has received a first volume of acidizing fluid. In addition, a first plug has been dropped into the wellbore ahead of the first volume of acidizing fluid. The first volume of acidizing fluid is acting downward against the production fluids.

FIG. 3B is a next side view of the well site 300 of FIG. 3A. Here, the wellbore 310 has received a first volume of acidizing fluid. The first volume of acidizing fluid is indicated at 315. In addition, a first plug 325 has optionally been dropped into the wellbore 310 ahead of the first volume of acidizing fluid 315. The first plug 325 is generally arranged in accordance with plug 200 of FIG. 2A. In this respect, the plug 325 may be a relatively dense or solid, cylindrical device fabricated from a material that is reactive with acid.

The first plug 325 will have an outer diameter that is smaller than the inner diameter of the seat 336. In this way, the first plug 325 will not catch on the seat 336 while the first volume of acidizing fluid 315 is being injected into the wellbore 310; instead, the plug 325 will be pumped past the zone of interest "T" and to the lower end 334 of the production casing 330.

In FIG. 3B, the first volume of acidizing fluid 315 is acting downwardly against the wellbore fluids 305. A combination of hydrostatic head and pumping pressure act against the wellbore fluids 305. The first plug 325 separates the first volume of acidizing fluid 315 from the wellbore fluids 305. This preserves the integrity of the first volume of acidizing fluid 315 as a substantially pure fluid. Stated another way, the first plug 325 prevents the first volume of acidizing fluid 315 from bypassing or mixing with the wellbore fluids 305. This is of particular concern where the wellbore 310 is deviated or, particularly, where the wellbore 310 is almost horizontal. In that instance, differences in fluid density can create the potential for fluid bypass.

In FIG. 3B, the wellbore fluids 305 are being pushed into the formation 350 ahead of the first plug 325. Wellbore fluids 305 are entering both the zone of interest "T" and the zone of interest "U."

Figure 3C:
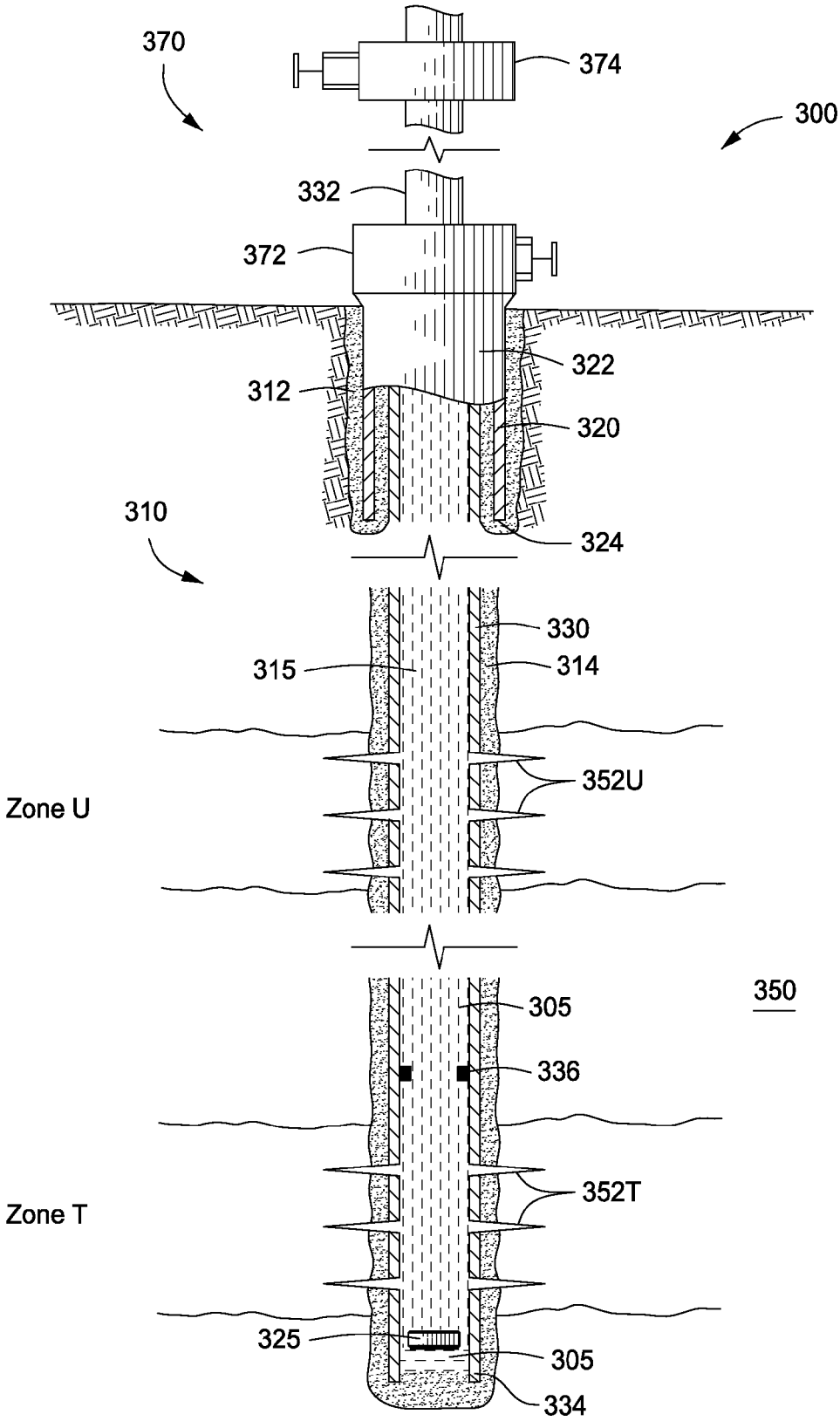
FIG. 3C is another side view of the well site of FIG. 3A. Here, the first volume of acidizing fluid is being injected into the zone of interest "T."

FIG. 3C is another side view of the well site 300 of FIG. 3A. Here, the first volume of acidizing fluid 315 has moved down adjacent to the zone of interest "T." The first volume of acidizing fluid 315 is being injected into zones "T" and "U."

As shown in FIG. 3C, the first plug 325 has moved to the lower end 334 of the production casing 330. Because the first plug 325 is fabricated from a material that is reactive to acid, it has become smaller. The first plug 325 will completely dissolve in a matter of minutes.

Figure 3D:
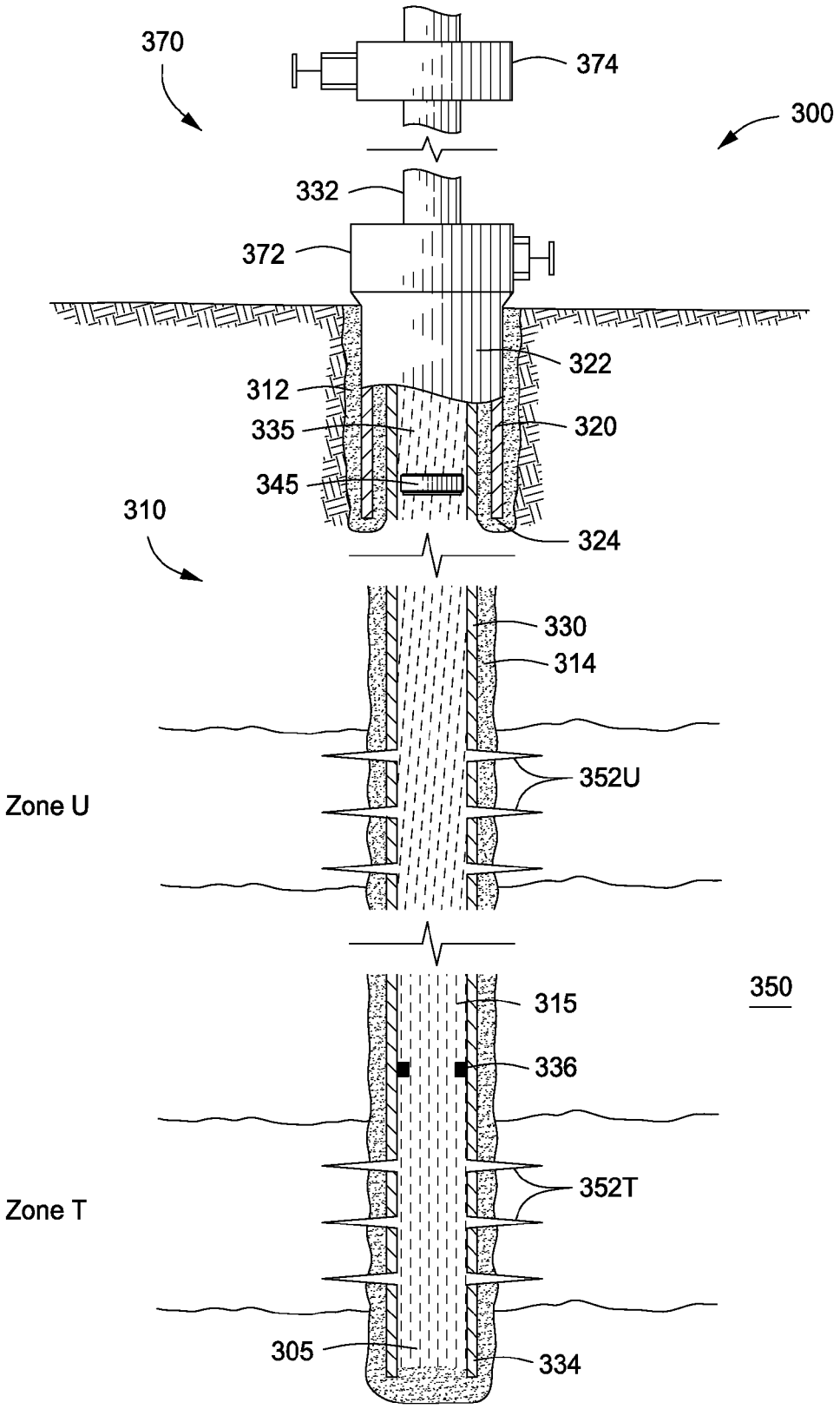
FIG. 3D is still another side view of the well site of FIG. 3A. Here, a second plug has been dropped into the wellbore. The second plug is being injected ahead of a second volume of acidizing fluid.

FIG. 3D is still another side view of the well site 300 of FIG. 3A. Here, a second volume of acidizing fluid has been injected into the wellbore 310. The second volume of acidizing fluid is indicated at 335. In addition, a second plug 345 has been dropped into the wellbore 310 ahead of the second volume of acidizing fluid 335. The second plug 345 is generally arranged in accordance with plug 200 of FIG. 2. In this respect, the plug 345 may be a relatively dense or solid, cylindrical device fabricated from a material that is reactive with acid.

The second plug 345 will have an outer diameter that is slightly larger than the inner diameter of the seat 336. In this way, the second plug 345 will catch on the seat 336 while the second volume of acidizing fluid 335 is being injected into the wellbore 310. This will allow the second plug 345 to serve as a diversion agent.

In FIG. 3D, the second volume of acidizing fluid 335 is acting downward against the first volume of acidizing fluid 315. A combination of hydraulic head and pumping pressure act against the first volume of acidizing fluid 315. The second plug 345 separates the second volume of acidizing fluid 335 from the first volume of acidizing fluid 315, although there is no concern here about preserving the integrity of the first volume of acidizing fluid 315 as the first 315 and second 335 volumes are typically of the same fluid composition.

In FIG. 3D, the first volume of acidizing fluid 315 is pushed into the formation 350 ahead of the second plug 345. The first volume of acidizing fluid 315 enters both the zone of interest "T" and the zone of interest "U," but primarily the lower zone "T."

Figure 3E:
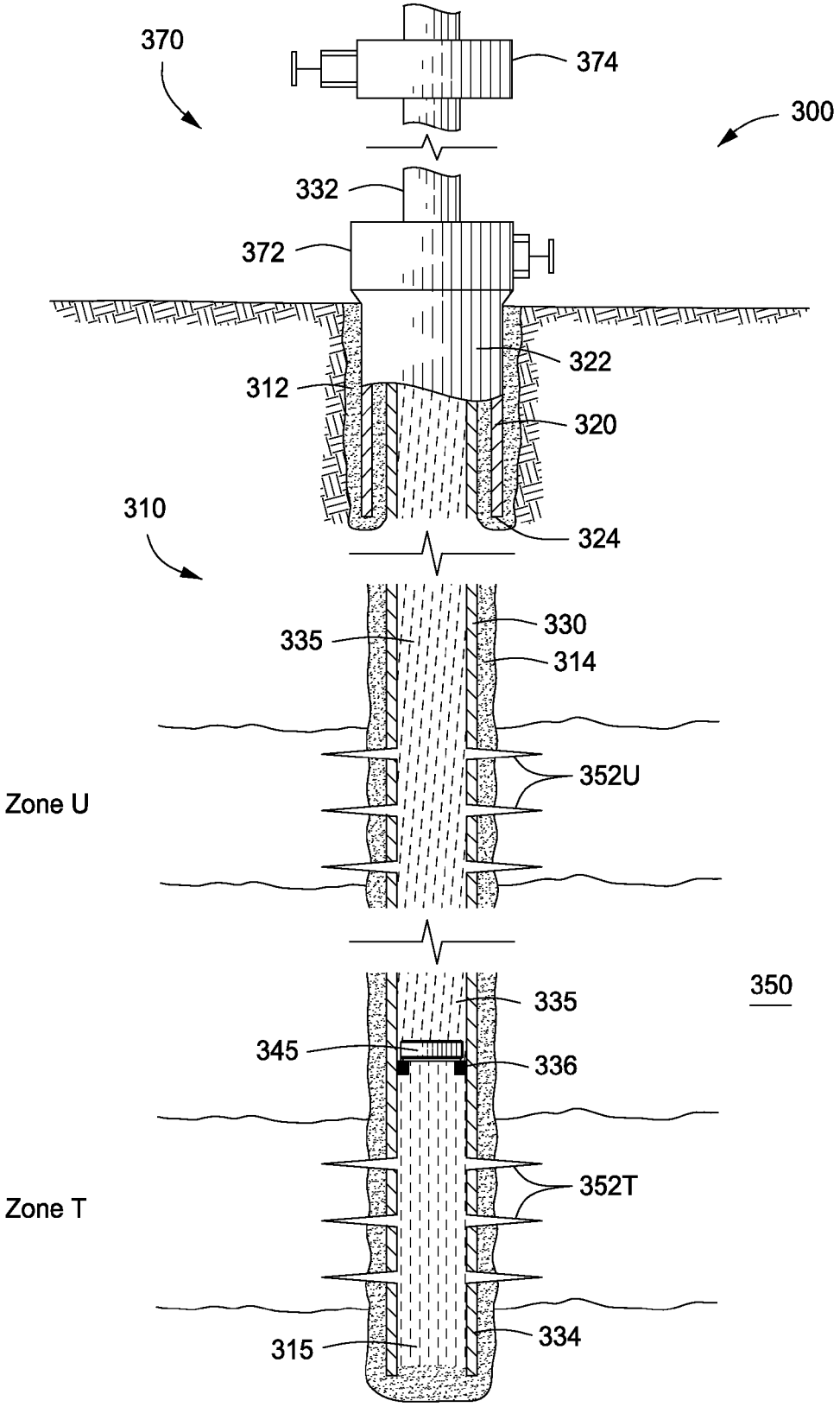
FIG. 3E is yet another side view of the well site of FIG. 3A. Here, the reactive second plug has landed on a seat along the production casing. The second volume of acidizing fluid is being injected into the zone of interest "U" above the second plug.

FIG. 3E is yet another side view of the well site 300 of FIG. 3A. Here, the second reactive plug 345 has landed on the seat 336 along the production casing 330. This prevents the further injection of fluid into the lowest zone of interest "T." The second volume of acidizing fluid 335 is now being effectively injected into the higher of the two zones of interest, to with, zone of interest "U."

It is noted that in the step of FIG. 3E, only one "second" reactive plug 345 is shown. However, the operator may choose to drop more than one "second" plug 345. For example, if the operator is concerned that the plug 345 may dissolve too quickly and not allow for a complete treatment into zone of interest "U," then the operator may choose to drop two, three or even more plugs. Alternatively, the operator may choose to stack a larger number of plugs, for example, 25 to 50 plugs, to temporarily cover a set of intermediate perforations so as to treat a higher zone of interest.

Figure 3F:
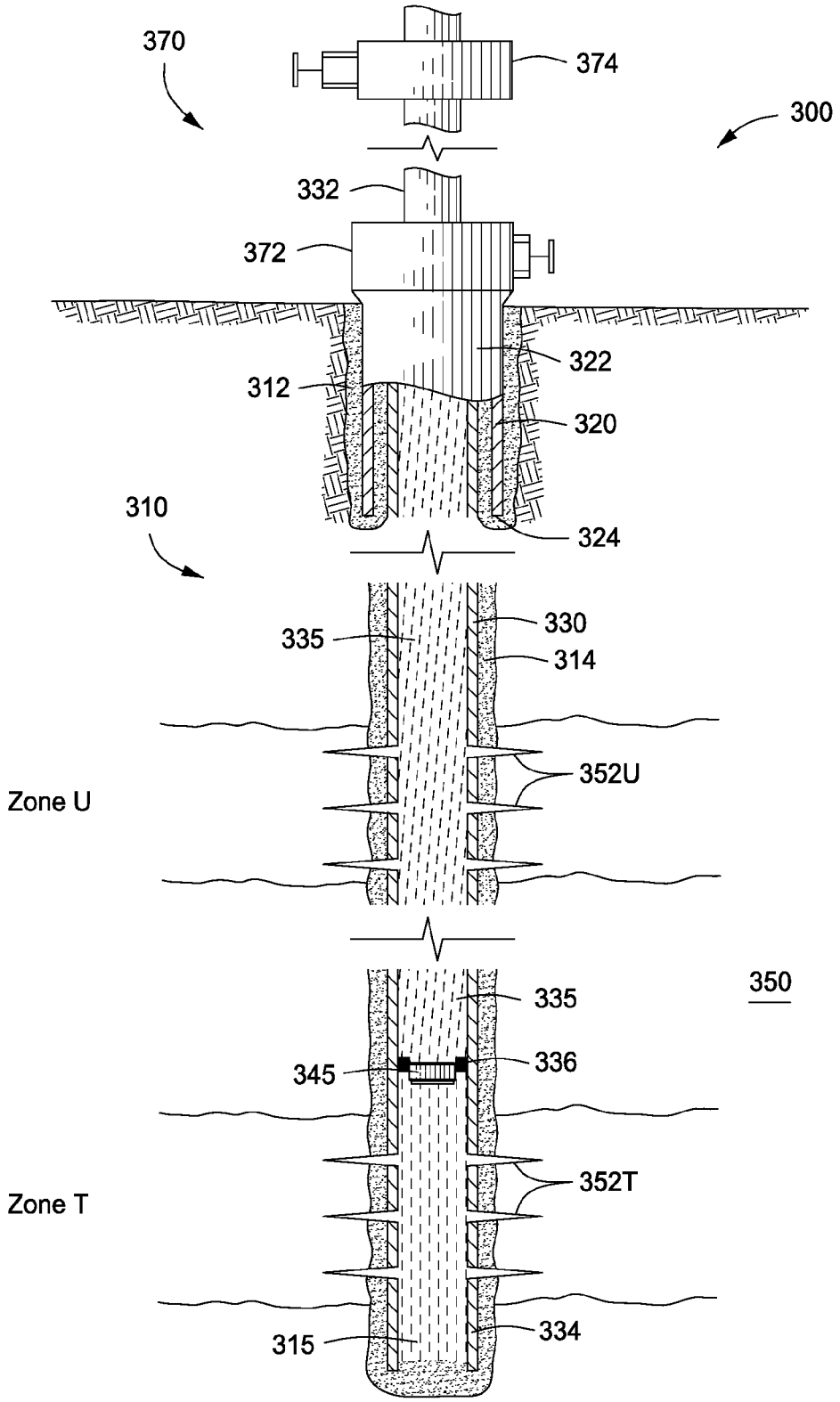
FIG. 3F is another side view of the well site of FIG. 3A. Here, the second plug is dissolving in reaction to the presence of the first and second volumes of acidizing fluid.

FIG. 3F is another side view of the well site 300 of FIG. 3A. Here, the second plug 345 is dissolving in reaction to the presence of the first 315 and second 335 volumes of acidizing fluid. In response to hydrostatic pressure and pumping pressure applied to the second volume of acidizing fluid 335, the second plug 345 has become "unseated" from the seat 336. Once the seal is broken between the seat 336 and the second plug 345, acidic fluids from the second volume 335 will quickly begin invading all zones of interest.

It is noted that the second plug 345 is fabricated so that it's dissolution will not initiate until time has passed to permit an acceptable volume of acidizing fluid (volume 335) to be injected into the corresponding zone of interest. In one aspect, the second plug 345 is fabricated so that significant dissolution will not take place until the desired amount of acidic fluid enters Zone "U." In another aspect, the plug 345 is fabricated so that significant dissolution will not take place for between 5 minutes and 15 minutes.

Figure 3G:
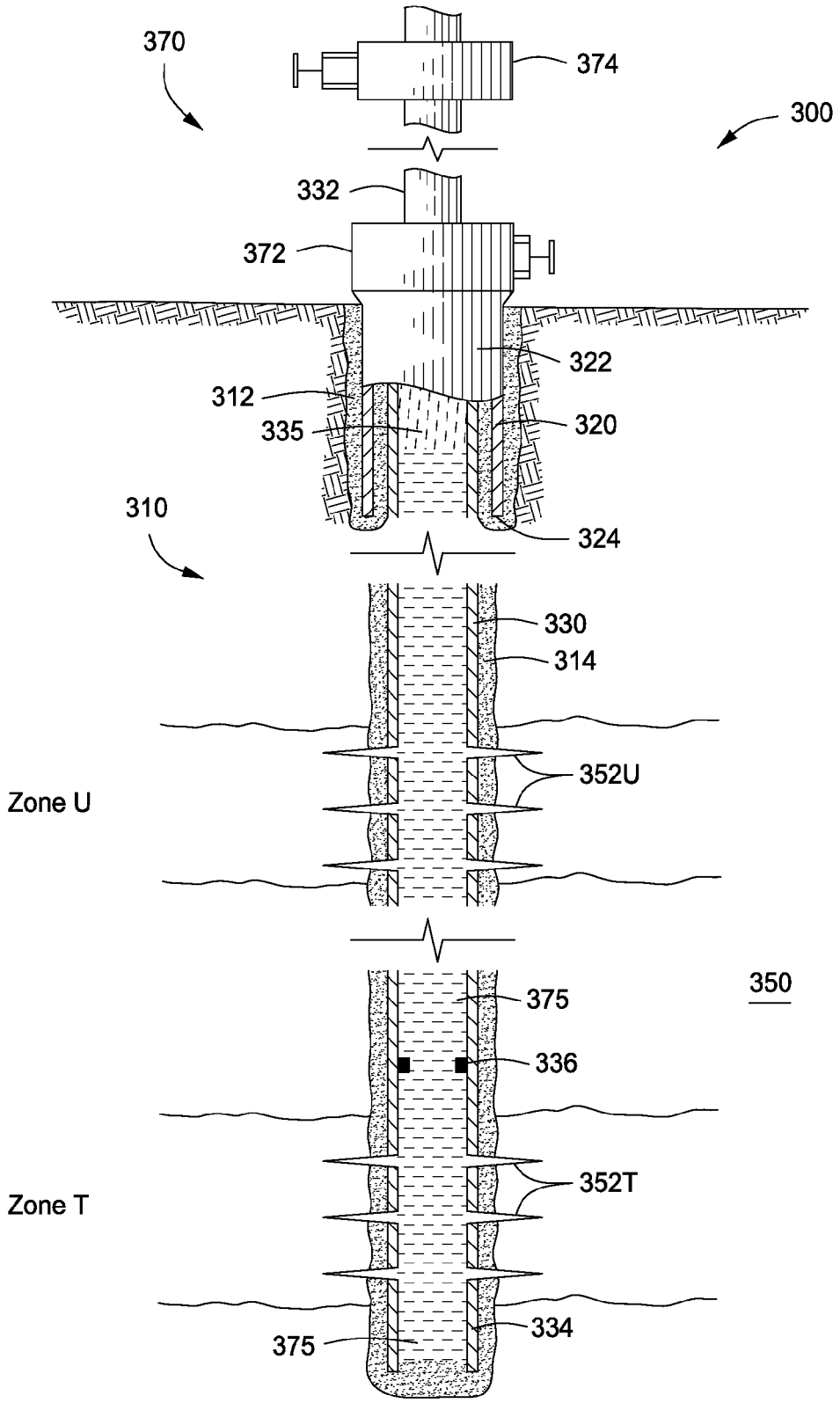
FIG. 3G is a final side view of the well site of FIG. 3A. Here, the wellbore has been placed back in production. Formation fluids are being produced from zones "T" and "U." The second plug has completely dissolved.

FIG. 3G is a final side view of the well site 300 of FIG. 3A. Here, the wellbore 310 has been completed and placed in production. Formation fluids 375 are being produced from both zones "T" and "U." The first 325 and second 345 plugs have long been dissolved. The second volume of acidizing fluid 335 is being returned to the surface 101 with the formation fluids 375.

FIGS. 3A through 3G demonstrate the use of a substantially solid diversion plug as may be used to acidize or otherwise stimulate two separate zones of interest (zones "T" and "U") within an illustrative wellbore 310. While only two zones of interest are shown, it is understood that the stimulation process illustrated in FIGS. 3A through 3G may be used to treat multiple zones. It is also understood that where the wellbore 310 is substantially vertical, the first plug 325 is optional. All that is required is that plugs used to divert treatment fluids from a lowest zone of interest be dimensioned to land on a seat provided along an inner diameter of the production casing 330.

An alternate process is disclosed herein that does not require the use of substantially solid plugs and seats. FIG. 4 provides a perspective view of a viscous plug 400 that may be used in lieu of the dense plug 200 of FIGS. 2A and 2B. The viscous plug 400 defines an elongated cylindrical body 410. The body 410 may be, for example, about two feet (0.6 meters) up to 30 feet (9.1 meters) or even up to 50 feet (15.2 meters) in length. Preferably, the cylindrical body 410 is dimensioned to be transported in the bed of a pick-up truck or in a delivery truck.

The cylindrical body 410 defines a gelatinous object having a high viscosity at ambient conditions (15° C. and 1 atm pressure). For example, the viscosity may be greater than about 50 centipoise, and more preferably, greater than about 75 centipoise. The plug 400 has a diameter that approximates the inner diameter of the production casing (such as production casing 106). For transportation purposes, the plug 400 may be wrapped in thick, water-proof paper or plastic to facilitate handling. This outer covering would be removed before the plug 400 is dropped into the casing string. Alternatively, the plug 400 may include an encapsulating hardened shell to facilitate handling. In any instance, the plug 400 represents a defined geometry, as opposed to an amorphous fluid, a volume of rock salt, or a foam.

As with the plug 200, the plug 400 is fabricated from a material that will dissolve in the presence of fluids. Where the plug 400 is used as part of a multi-zone acidization procedure, the plug 400 will be fabricated from a material that dissolves in the presence of acid. An example of such an acid is an acidic fluid comprised of about 15% to 50% hydrochloric acid or formic acid. Where the plug 400 is used as part of a multi-zone fracturing procedure, the plug 400 is fabricated from a material that dissolves in the presence of brine. Examples of suitable material include sodium bicarbonate, calcite rock, chalk rock, or combinations thereof.

Preferably, the material that dissolves in the presence of fluid will begin to dissolve in about 1 minute to 30 minutes. More preferably, the material will begin to dissolve in about 5 minutes to 15 minutes. In addition, it is desirable that the material forming the plug 400 have a density that is greater than the fluid that is pushing it in the wellbore. In this way, the plug 400 can move downward through the production casing in response to both gravitational pull and pumping.

The viscous plug 400 has an outer diameter dimensioned to closely fit into the inner diameter of a string of production casing. In one aspect, multiple plugs 400 having a length of about 5 feet (1.5 meters) are dropped into a wellbore in a stack. Using shorter length plugs allows the plugs 400 to be easily delivered to a wellsite and carried by hand.

In operation, one or more plugs 400 are dropped into a wellbore, and then pumped downhole. When the plug 400 reaches the lowest set of perforations, the plug 400 will be dissolving while choking the flow into the surrounding zone of interest. This, in turn, has the effect of substantially diverting injected fluid into an upper unstimulated zone until the acidic fluid significantly dissolves the plug 400.

FIGS. 5A through 5J demonstrate a process for treating multiple zones of interest in a wellbore sequentially using a reactive, viscous plug 400.

Figure 5A:
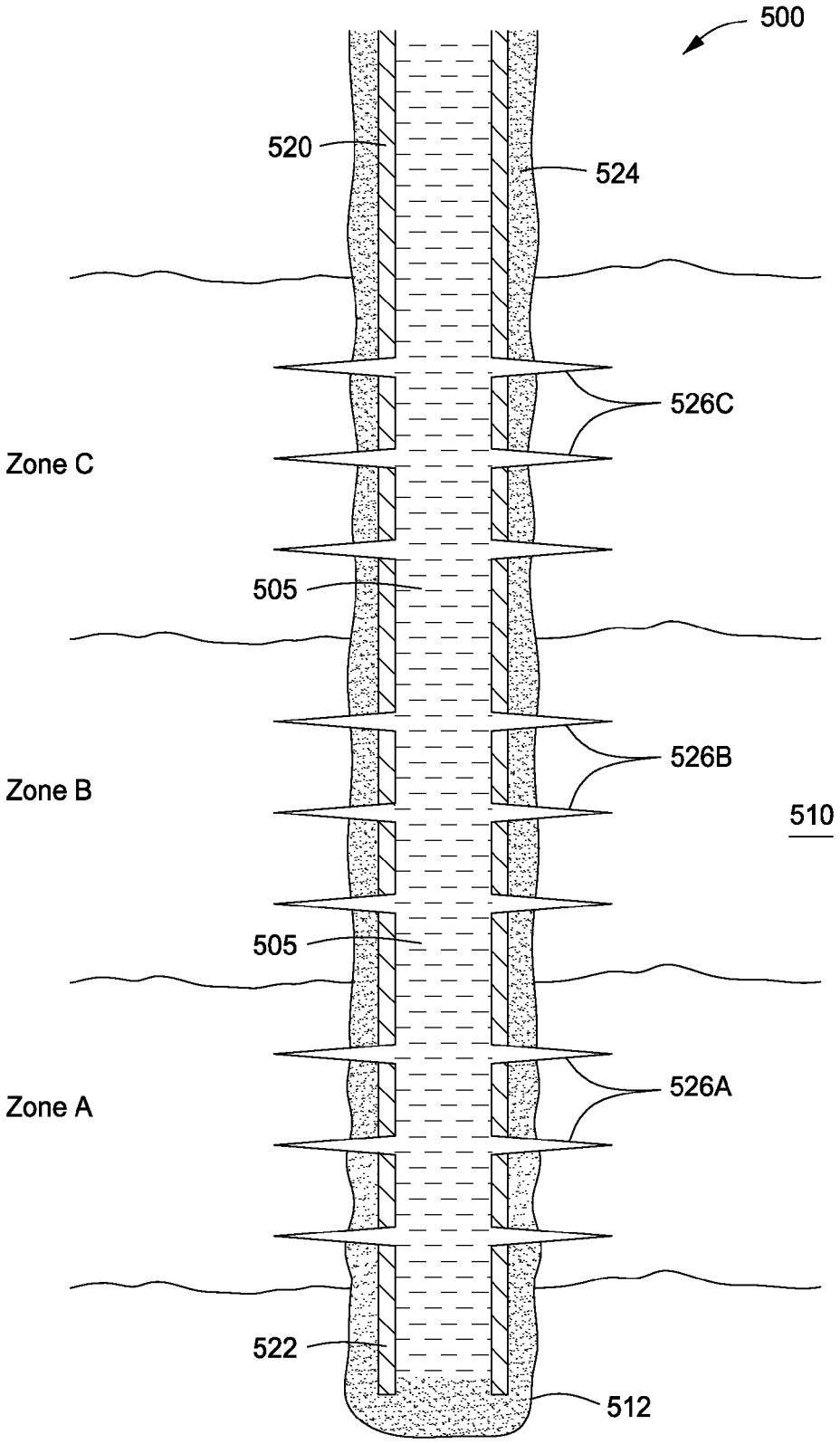
FIG. 5A is a side view of a portion of a wellbore. The wellbore has been completed in multiple zones of interest, including zones "A," "B," and "C." The wellbore has production fluids therein.

First, FIG. 5A is a side view of a lower portion of a wellbore 500. The wellbore 500 has been completed in multiple zones of interest, including zones "A," "B," and "C." The zones of interest "A," "B," and "C" reside within a subsurface 510 containing hydrocarbon fluids. The wellbore 500 has been perforated at each of zones "A," "B," and "C." Perforations are seen at 526A, 526B, and 526C, corresponding to zones "A," "B," and "C."

The wellbore 500 includes a string of production casing (or, alternatively, a liner string) 520. The production casing 520 has been cemented into a formation 510 to isolate the zones of interest "A," "B," and "C" as well as other strata along the formation 510. A cement sheath is seen at 524.

The wellbore 500 has a bottom end at 512. The production string 520 also has a lower end 522 that extends to the bottom end 512 of the wellbore 500.

The wellbore 500 is part of a well that is being formed or has been formed for the production of hydrocarbons. In order to stimulate production from the formation 510, it is desirable to circulate acid adjacent to and within each of the zones of interest "A," "B," and "C." This may be done either during completion of the well, or later as part of a remediation operation.

In the view of FIG. 5A, the production casing 520 is filled with wellbore fluids. The wellbore fluids are indicated at 505. Where the wellbore 500 is undergoing completion, the wellbore fluids 505 may represent a combination of drilling mud, formation fluids, and completion fluids used in connection with perforating the zones of interest "A," "B," and "C." Where the wellbore 500 has been under production and the formation 510 is now undergoing remediation, the wellbore fluids 505 represent fluids that have been produced from the zones of interest "A," "B," and "C." In any event, the wellbore fluids 505 will be temporarily pushed into the formation 510 as part of the acidizing operation.

Figure 5B:
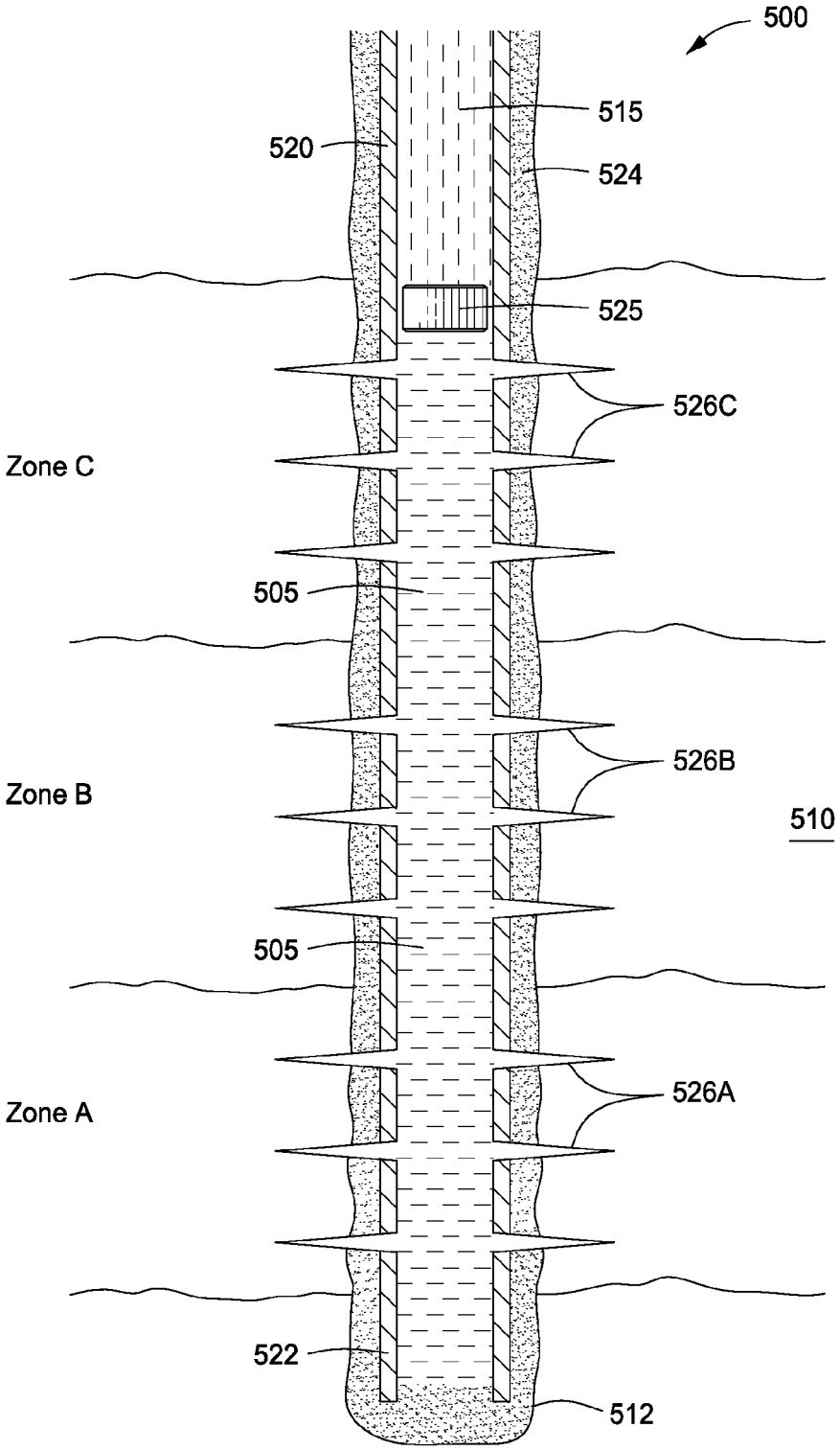
FIG. 5B is another side view of the wellbore of FIG. 5A. Here, the wellbore has received a first volume of acidizing fluid. The first volume of acidizing fluid is acting downward against production or wellbore fluids, pushing them back into the formation at the zones of interest. An optional first plug has also been dropped into the wellbore ahead of the first volume of acidizing fluid to avoid mixing of the acidic fluid with the wellbore fluids.

FIG. 5B is another side view of the wellbore 500 of FIG. 5A. Here, the wellbore 500 has received a first volume of acidizing fluid 515. In addition, a first plug 525 has optionally been injected into the wellbore 500 ahead of the first volume of acidizing fluid 515. In this arrangement, the first plug 525 comprises a pumpable viscous gel. The gelatinous plug 525 defines a cylindrical body, and helps to isolate the first volume of acidizing fluid 515 from the wellbore fluids 505. This preserves the integrity of the first volume of acidic fluid 515, and also prevents the first volume of acidizing fluid 515 from bypassing the wellbore fluids 505. This may be of particular importance where the wellbore 500 is deviated.

It is preferred that the first plug 525 have a short length, such as less than about 5 feet (1.5 meters). In this way, the first plug 525 can substantially clear the perforations 526A in zone "A." This, in turn, allows the first volume of acidizing fluid 515 to penetrate the formation 510 above the bottom end 512 of the wellbore 500 without being blocked by the viscous plug 525.

It is also preferred that the viscous plug 525 be coated with a polymeric or elastomeric material that delays the dissolution of the material making up the first plug 525. For example, the coating may inhibit dissolution for about 5 to 15 minutes. This will help prevent the viscous plug 525 from significantly dissolving before reaching the bottom 512 of the wellbore 500.

In FIG. 5B, the first volume of acidizing fluid 515 is acting downwardly against the wellbore fluids 505. A combination of hydrostatic pressure and pumping pressure act against the wellbore fluids 505. The wellbore fluids 505 are being pushed into the formation 510 at the zones of interest "A," "B," and "C."

Figure 5C:
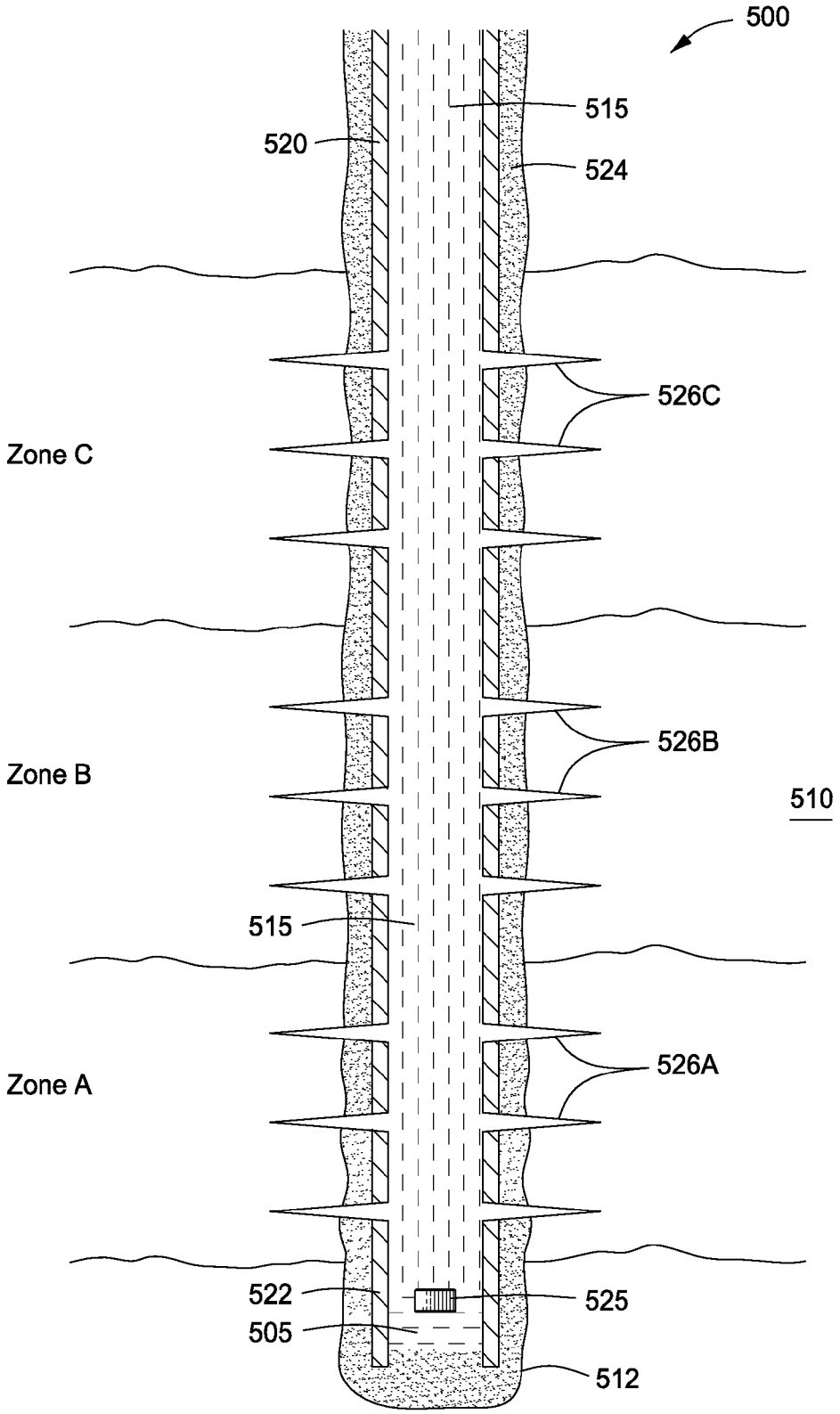
FIG. 5C is another side view of the wellbore of FIG. 5A. Here, the first volume of acidizing fluid is being injected into the zone of interest "A."

FIG. 5C is another side view of the wellbore 500 of FIG. 5A. Here, the first volume of acidizing fluid 515 has reached the lowest zone of interest "A." The first volume of acidizing fluid 515 is now being injected into zones "A," "B," and "C."

As shown in FIG. 5C, the first plug 525 has been pumped below the zone of interest "A." The first plug 525 is now at the bottom end 512 of the wellbore 500. Because the first plug 525 is fabricated from a material that is reactive to acid, it is beginning to dissolve. The first plug 525 will completely dissolve in a matter of minutes.

Figure 5D:
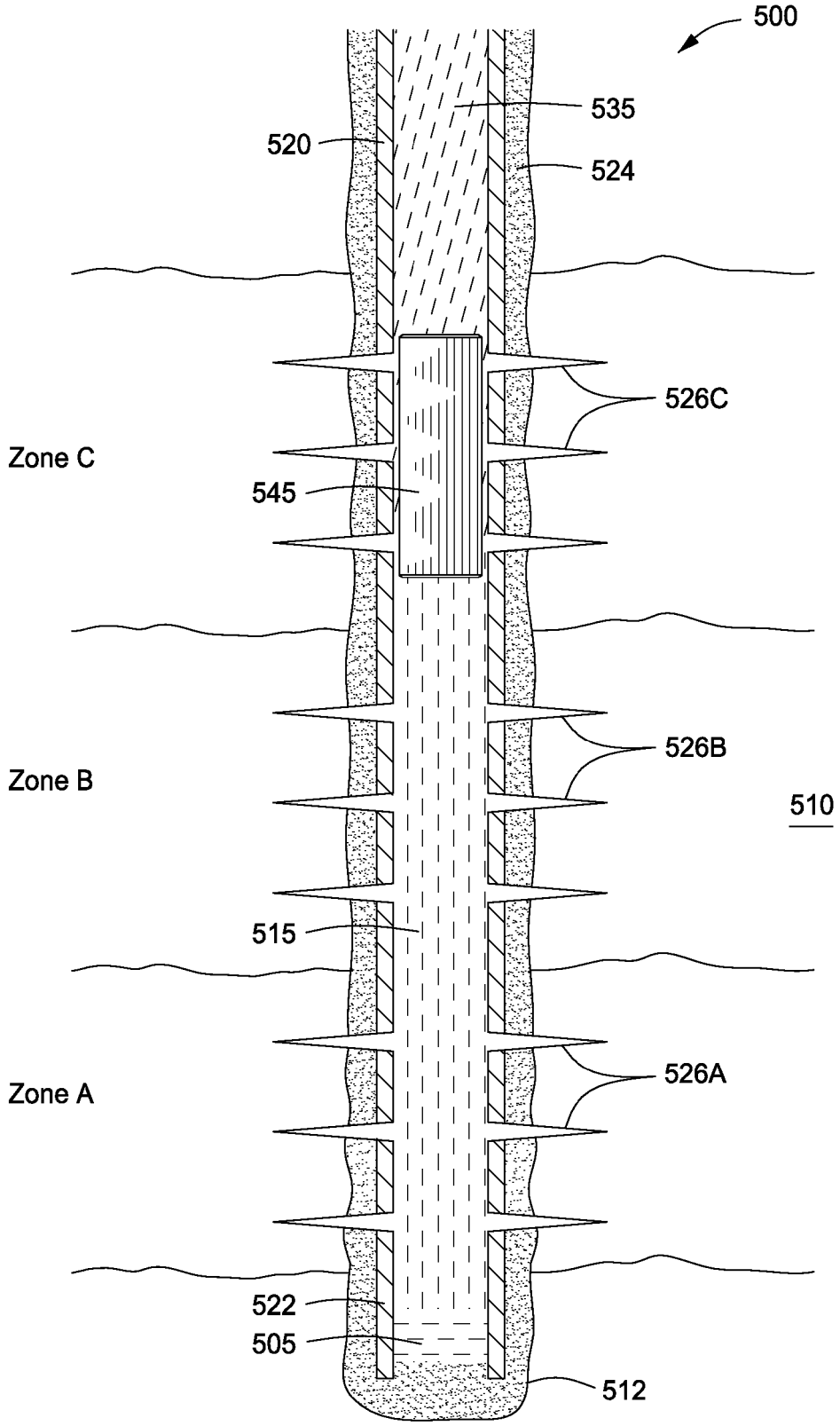
FIG. 5D is another side view of the wellbore of FIG. 5A. Here, a second plug has been dropped into the wellbore. The illustrative plug is a viscous plug, and is being injected ahead of a second volume of acidizing fluid.

FIG. 5D is another side view of the wellbore of FIG. 5A. Here, a second volume of acidizing fluid has been injected into the wellbore 500. The second volume of acidizing fluid is indicated at 535. In addition, a second plug 545 has been dropped into the wellbore 500 ahead of the second volume of acidizing fluid 535. The second plug 545 also comprises a pumpable viscous gel that is reactive with acid. The second plug 545 defines a cylindrical body that may be handled at the surface and manually dropped into the wellbore 510. The viscous second plug 545 will significantly dissolve within the wellbore 500 along zone of interest "A." In this respect, the plug 545 will temporarily block the perforations 526A for a period of time, allowing the second plug 545 to serve as a diversion agent.

The second plug 545 is generally arranged in accordance with plug 400. The second plug 545 has a length designed to cover all of the perforations 526A along zone "A." The second plug 545 may be a single elongated plug or may be two or more plugs stacked and dropped together.

To ensure that the viscous plug 545 does not begin to dissolve along any of the upper zones of interest, e.g., zone "B" and zone "C," it is again preferred that the viscous plug 545 be coated with a polymeric or elastomeric material that delays the dissolution of the material making up the second plug 545. This will help prevent the viscous plug 545 from dissolving before reaching the perforations 526C.

In FIG. 5D, the second volume of acidizing fluid 535 is acting downward against the first volume of acidizing fluid 515. A combination of hydrostatic pressure and pumping pressure act against the first volume of acidizing fluid 515. The second plug 545 separates the second volume of acidizing fluid 535 from the first volume of acidizing fluid 515. This preserves the integrity of the first volume of acidizing fluid 515 as a substantially pure fluid. Of course, it is likely that the composition of the first 515 and second 535 volumes of acidizing fluid will have the same composition, so fluid mixing or bypassing may not be of concern.

In FIG. 5D, the first volume of acidizing fluid 515 is pushed into the formation 550 ahead of the second plug 545. The first volume of acidizing fluid 515 enters both the zone of interest "A" and the zone of interest "B," but primarily the zone of interest "A."

FIG. 5E(1) is yet another side view of the wellbore 500 of FIG. 5A. Here, the second reactive plug 545 has set in the production casing 520 below zone of interest "B." More specifically, the viscous plug 545 has dissolved, and has temporarily plugged or clogged the perforations 526A along zone of interest "A." This prevents the further injection of fluid into the lowest zone of interest "A" and provides a diversion mechanism for the second volume of acidizing fluid 535. The second volume of acidizing fluid 535 is now being effectively injected into zones "C" and "B."

It is again noted that the second plug 545 will have a length sufficient to reach each of the perforations 526A in zone "A." For example, the second plug 545 may be about 20 feet (6.1 meters) to 30 feet (9.1 meters), or even up to 50 feet (15.2 meters), in length. As an alternative, the operator may choose to drop more than one viscous plug to serve as the second plug 545. This means that two, three, or more cylindrical plugs may be dropped sequentially to ultimately seal the perforations 526A along zone of interest "A." Moreover, multiple "second" plugs 545 may be dropped into the production casing 520 with the idea that they will land at the bottom 512 of the wellbore 500, and then stack.

FIG. 5E(2) provides another side view of the wellbore 500 of FIG. 5A. Here, the second reactive plug 545 comprises a plurality of plugs stacked from the bottom 512 of the wellbore 500 in order to temporarily cover the perforations 526A along the zone of interest "A." Again, these are viscous plugs that will quickly dissolve in the presence of acid. The material making up the second plugs 545 will later be circulated back to the surface with the acidic fluids.

Whether using the step of FIG. 5E(1) or the step of FIG. 5E(2), the operator may be able to tell when the perforations 526A along zone "A" are plugged. In this respect, the operator may see a steeper decrease in pumping pressure while the second volume of acidizing fluid is being pumped. This steeper decrease will occur as the second viscous plug(s) 545 dissolves and the perforations 526A along zone "A" are opened up.

Figure 5F:
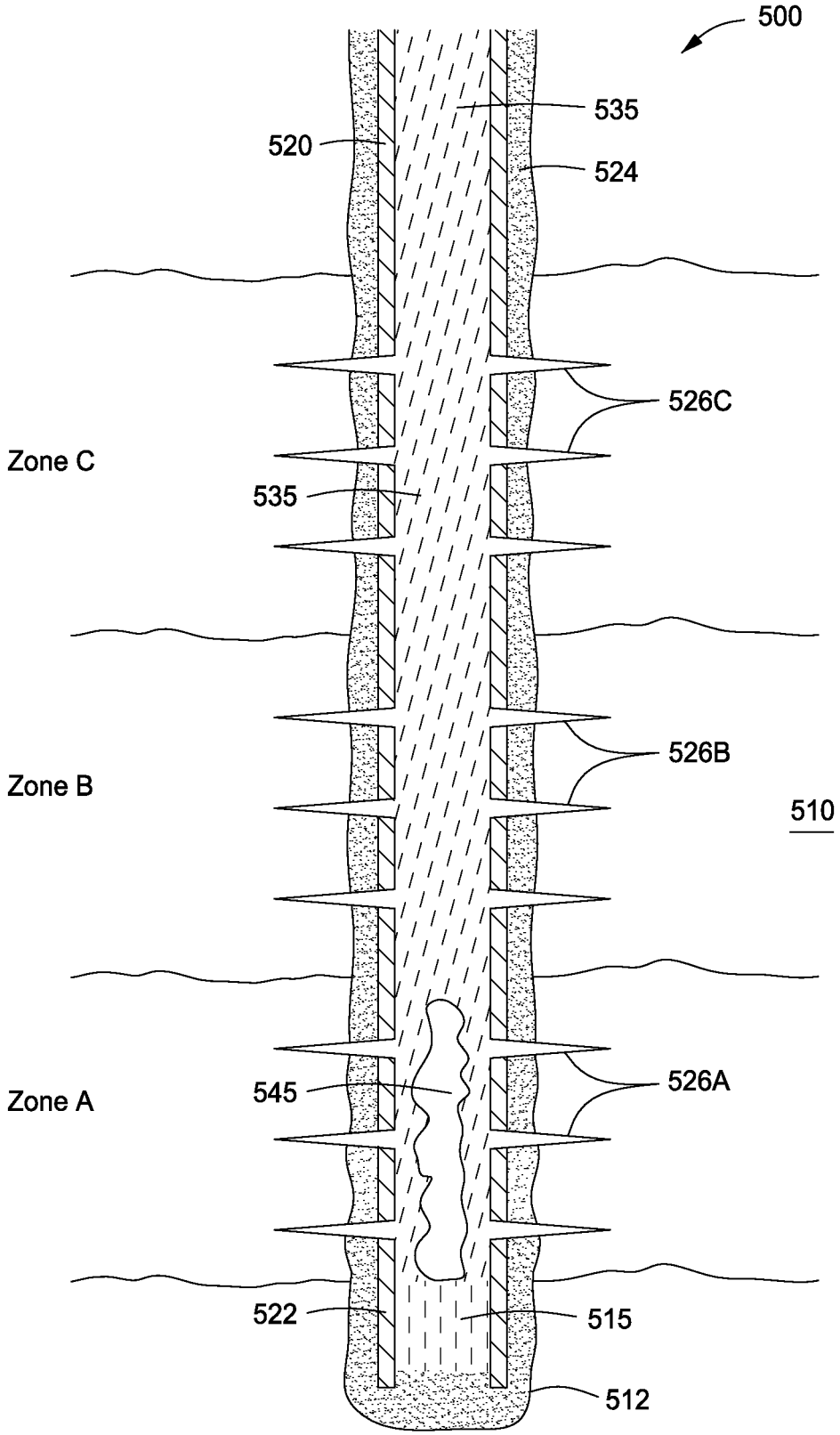
FIG. 5F is a subsequent side view of the wellbore of FIG. 5E(1). Here, the second viscous plug is dissolving in reaction to the presence of the first and second volumes of acidizing fluid.

FIG. 5F is a subsequent side view of the wellbore 500 of FIG. 5E(1). Here, the second viscous plug 545 is dissolving in reaction to the presence of the first 515 and second 535 volumes of acidizing fluid. However, the second plug 545 is fabricated so that it will not significantly dissolve until time has passed to permit an acceptable volume of acidizing fluid (volume 535) to be injected into the zones of interest above, e.g., zone "B." In one aspect, the second plug 545 is fabricated so that dissolution will not begin to take place for between 10 minutes and 40 minutes from injection into the wellbore 500.

FIG. 5G(1) is still another side view of the wellbore of FIG. 5A. Here, a third volume of acidizing fluid has been injected into the wellbore 510. The third volume of acidizing fluid is indicated at 555. In addition, a third plug 565' has been dropped into the wellbore 500 ahead of the third volume of acidizing fluid 555. The third plug 565' also comprises a pumpable viscous gel that is reactive with acid. The third plug 565' may be a very long gelatinous object, such as about 30 feet (9.1 meters) to 60 feet (18.3 meters) in length. Alternatively and more preferably, and as shown in FIG. 5G(1), the third plug 565' may actually comprise a series of shorter plugs that together create a long plugging body. For example, the long plugging body may be up to 100 feet (30.5 meters) or even 200 feet (61.0 meters) in length.

The plug 565' is designed to temporarily cover and seal the perforations 526A at zone of interest "A." In addition, the plug 565' is dimensioned to temporarily cover and seal the perforations 526B at zone of interest "B." In this way, the third viscous plug 565' serves as a diverting mechanism to divert fluids into the upper zone of interest, to with, zone "C."

In FIG. 5G(1), the third volume of acidizing fluid 555 is acting downward against the third plug (s) 565'. A combination of hydrostatic pressure and pumping pressure act against the second volume of acidizing fluid 535. The third plug 565' separates the third volume of acidizing fluid 555 from the second volume of acidizing fluid 535. This preserves the integrity of the second volume of acidizing fluid 535 as a substantially pure fluid. Of course, it is likely that the composition of the second 535 and third 555 volumes of acidizing fluid will have the same composition, so fluid mixing or bypassing may not be of concern.

In FIG. 5G(1), the second volume of acidizing fluid 535 is pushed into the formation 510 ahead of the third plug 565. The second volume of acidizing fluid 535 enters both the zone of interest "A" and the zone of interest "B."

Because of the length of plugging material needed to cover the perforations 526A and 526B when a gelatinous plug 565' is used, the operator may choose to instead use a rigid plug, such as the plug 200 of FIG. 2A. In this instance, the operator may land the rigid plug on a seat without worrying about temporarily sealing multiple zones below zone of interest "C." The rigid plug may be about 4 inches (10.16 cm) to 5 feet (1.5 meters) in length.

FIG. 5G(2) provides an alternate side view of the wellbore 500 of FIG. 5A. Here, a third volume of acidizing fluid has once again been injected into the wellbore 510, indicated at 555. In addition, a third plug 565" has been dropped into the wellbore 510 ahead of the third volume of acidizing fluid 555. In this instance the plug 565" is a rigid plug in accordance with plug 200 of FIG. 2A.

As discussed above in connection with FIG. 3A, the production casing 520 has a seat 528 provided along an inner diameter. The seat 528 is placed above the zone of interest "B." The seat 528 is dimensioned to "catch" the plug 565" as it is pumped downhole. In this way, the third plug 565" acts as a diversion mechanism to direct the third volume of acidizing fluid 555 through the perforations 526C along the uppermost zone of interest "C."

It is understood the rigid plug 565" may also have a substantially elongated profile just as the gelatinous plug 565' of FIG. 5G(1). In this instance, the seat 528 could optionally be removed, and a plurality of rigid plugs 565" then stacked one on top of the other from the bottom of the wellbore. This would allow the perforations 526A, 526B in Zones "A" and "B" to be covered, as in the arrangement of FIG. 5G(1). Alternatively, the seat 528 could be placed above the zone of interest "A," and then one or more rigid plugs 565" stacked across the perforations 526B of the zone of interest "B."

Figure 5H:
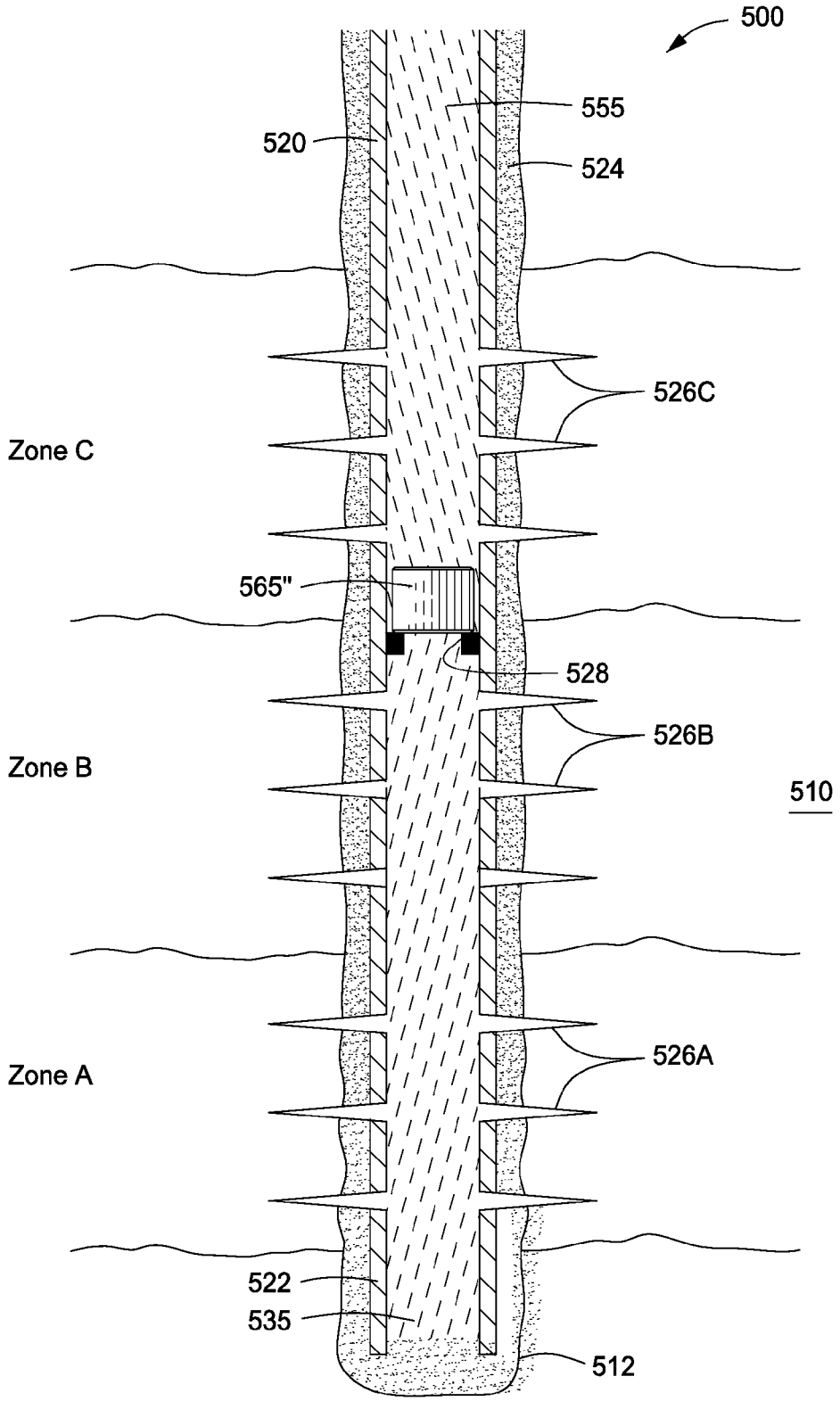
FIG. 5H is another side view of the wellbore of FIG. 5A, in sequence after the step of FIG. 5G(2). Here, the third plug has set in the production casing below zone of interest "C." The third volume of acidizing fluid is being injected into the zone of interest "C."

FIG. 5H is another side view of the wellbore 500 of FIG. 5A. The step show in FIG. 5H is in sequence after FIG. 5G(2). This means that a rigid plug 565" is being used to seal off the uppermost zone of interest "C." Here, the third plug 565" has set in the production casing 520 below zone of interest "C." More specifically, the rigid plug 565" has landed on the seat 528 above the perforations 528B.

The seat 528 prevents the further injection of fluids into the intermediate zone of interest "B." The third volume of acidizing fluid 555 is now being effectively diverted and injected into the zone of interest "C."

It is noted that the operator may choose to drop a viscous plug 565' as in FIG. 5G(1) on top of the rigid plug 565". This may provide a tighter seal for the injection of fluids above the seat 528.

Regardless of the plug arrangement in FIG. 5H, the third plug 565" (and optionally plug 565') may be fabricated so that it's dissolution is delayed until time has passed to permit an acceptable volume of acidizing fluid (third volume 555) to be injected into the corresponding zone of interest (zone "C"). In one aspect, the third plug 565" is fabricated with an outer layer of polymer so that dissolution of the third plug 565" will be inhibited or delayed by about an additional five minutes to one hour.

Figure 5I:
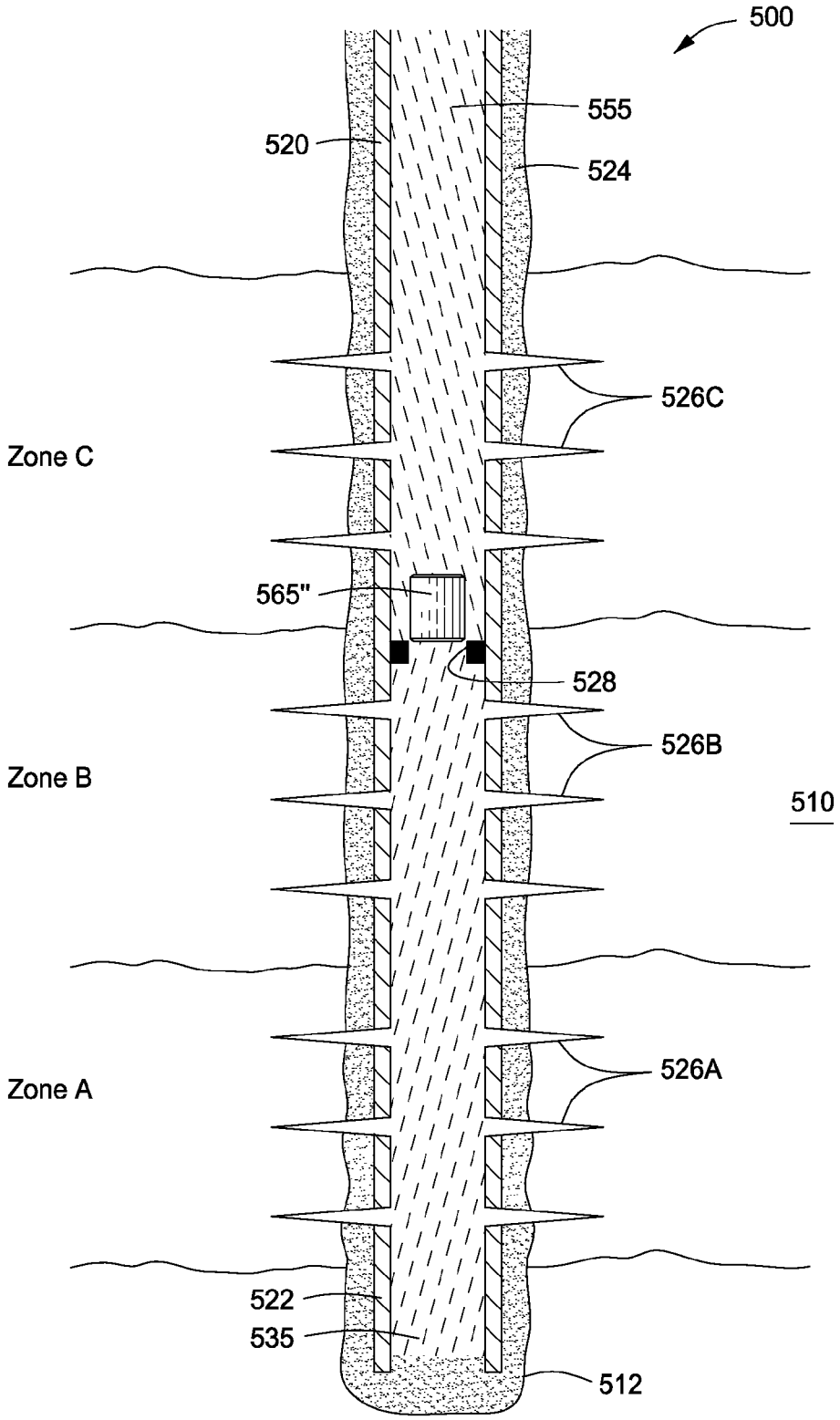
FIG. 5I is yet another side view of the wellbore of FIG. 5A. Here, the third plug is dissolving in reaction to the presence of the second and third volumes of acidizing fluid.

FIG. 5I is yet another side view of the wellbore 500 of FIG. 5A. Here, the third plug 565" is dissolving in reaction to the presence of the second 535 and third 555 volumes of acidizing fluid. The third plug 565" soon will no longer be seated on the seat 528 and the seal will be broken. This will be sensed at the surface as the pressure reading on pump gauge will begin to decline.

Figure 5J:
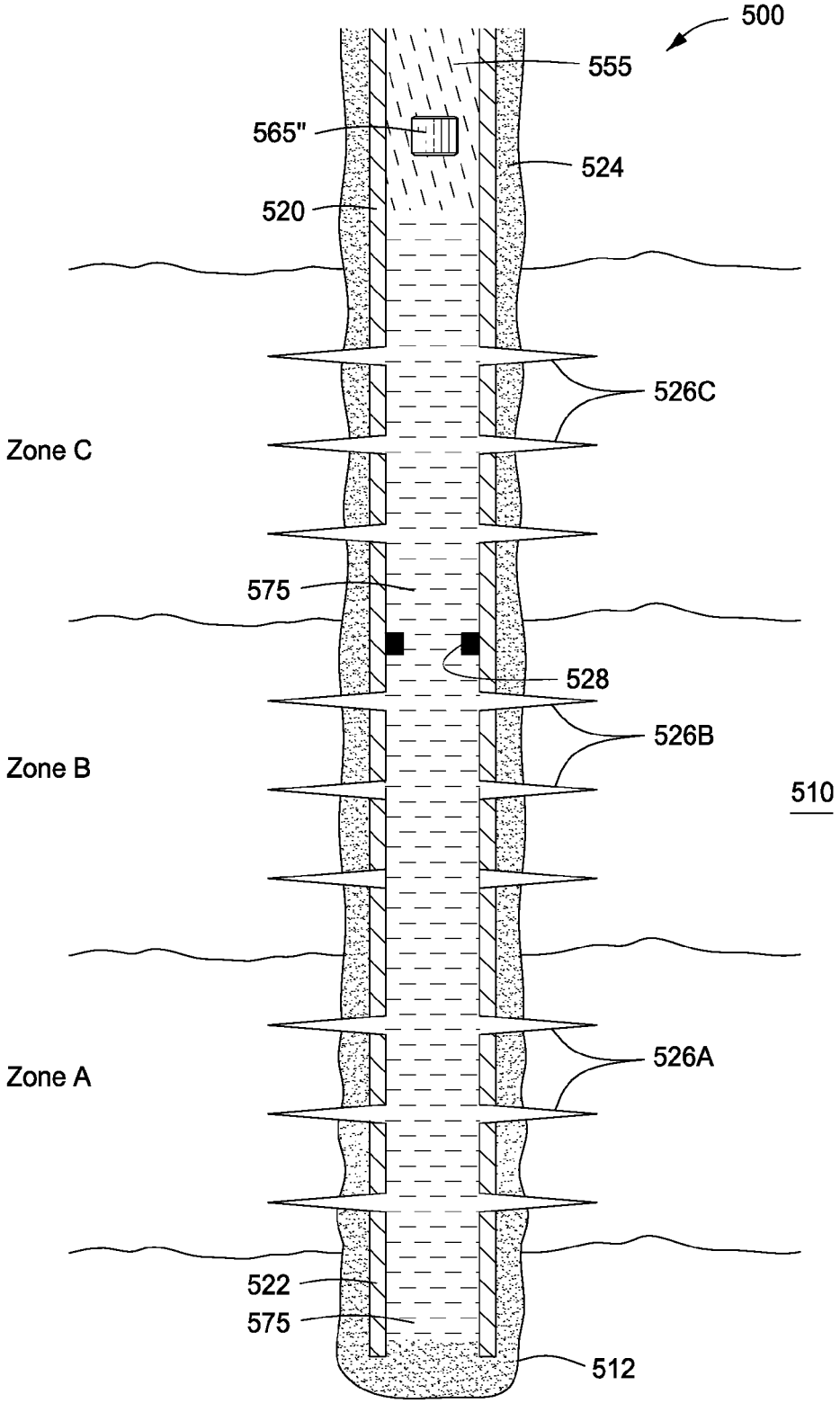
FIG. 5J is a final side view of the well site of FIG. 5A. Here, the wellbore has been placed back in production. Formation fluids are being produced from zones "A," "B," and "C." The first and second plugs have been completely dissolved. The third plug is shown in a state of partial dissolution, and is now being flowed back to the surface along with production fluids.

FIG. 5J is a final side view of the wellbore 500 of FIG. 5A. Here, the wellbore 500 has been placed in production. Formation fluids 575 are being produced from zones "A," "B," and "C." Formation fluids 575 are flowing towards the surface. The first 525 and second 545 plugs have long since dissolved. The third plug 565" is in a state of partial dissolution and is now being flowed back to the surface with the formation fluids 575.

Figure 6:
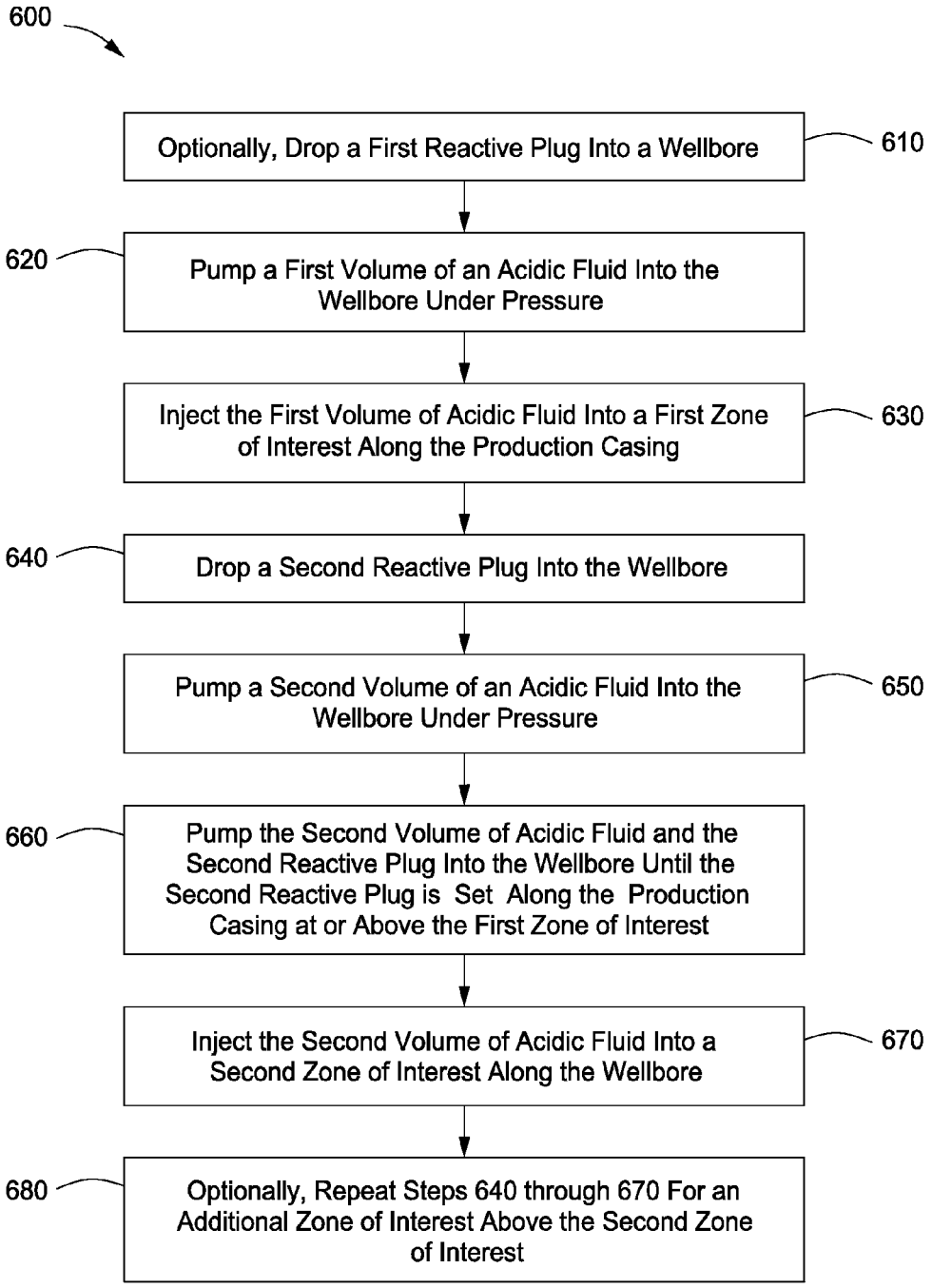
FIG. 6 is a flow chart showing steps for performing a method for treating a multi-zone wellbore, in one embodiment.

FIG. 6 is a flow chart showing steps for performing a method 600 for treating a multi-zone wellbore, in one embodiment. In accordance with the method 600, the wellbore is completed along multiple zones of interest. A string of production casing (or liner) has been run into the wellbore, and the production casing has been cemented into place.

The method 600 generally includes dropping a first plug into the wellbore. This is shown at Box 610. The first plug is fabricated from a material that dissolves in the presence of acidic fluid over a selected period of time. The first plug serves to separate a first volume of acidic fluid from wellbore fluids already residing in the wellbore.

The method 600 also includes pumping a first volume of acidic fluid into the wellbore under pressure. This step is provided at Box 620. The acidic fluid may be, for example, an acid solution containing about 15% to 50%, or more, hydrochloric acid, acetic acid, or formic acid. As the first volume of acidic acid is pumped into the wellbore, it pushes the first plug down the wellbore. Injecting also pushes existing wellbore fluids back into the formation at the various zones of interest.

The method 600 also includes injecting the first volume of acidic fluid into a first zone of interest along the production casing. This is provided at Box 630. As pumping from the step of Box 620 continues, the first plug will be pushed below the first zone of interest. Pumping continues until the first volume of acidic fluid is injected into the first zone of interest along the production casing.

The method 600 also includes dropping a second plug into the wellbore. This is seen at Box 640. The second plug is also fabricated from a material that substantially dissolves in the presence of the acidic fluid over a selected period of time. For example, the plug may not substantially dissolve for about 10 minutes to about 45 minutes. Optionally, a polymeric or elastomeric coating is placed around the second plug to inhibit dissolution of the plug material. For example, the coating may inhibit the dissolution process for about 5 to 15 minutes. The dissolution time of the second plug may be "tuned" by increasing the thickness of the coating. For example, a 1 mm coating of elastomeric material may equate to 5 minutes of additional dissolution time. Of course, various factors will affect dissolution time, including the concentration of the acid and the composition of the elastomeric material.

The second plug may be a relatively short, rigid plug. In this instance, the plug will land on a seat above the first zone of interest. Alternatively, the second plug may be a longer, viscous plug having a gelatinous composition. In this instance, the plug will rest on the bottom of the wellbore and extend across the first zone of interest to substantially seal perforations along the first zone of interest. Alternatively, the viscous plug will break up under pumping pressure and temporarily plug the perforations along the first zone of interest. In any event, the second plug has a defined geometry, as opposed to merely being a volume of foam or rock salt.

The method 600 also includes pumping a second volume of acidic fluid into the wellbore under pressure. This is indicated at Box 650. The second volume of acidic fluid pushes the second plug down the wellbore. The plug eventually sets at or above the first zone of interest. This is provided at Box 660. The second plug thus serves as a diversion mechanism to prevent acidic fluids from being pumped down to the first zone of interest. Stated another way, the second plug serves as a fluid diversion plug.

The method then includes injecting the second volume of acidic fluid into a second zone of interest along the production casing. This is seen at Box 670. The second zone of interest is above the first zone of interest. The second volume of acidic fluid is diverted into the second zone of interest by the plug before the plug dissolves. In one aspect, the second plug actually defines two or more plugs that are stacked one on top of the other within the production casing in order to extend the plug's length. Using two or more stacked plugs may also increase the plugging capability of the second plug.

The above steps may be repeated for a third zone of interest. This is indicated at Box 680. The third zone will be above the second zone of interest. A third plug will be deployed in the wellbore that is also reactive with acidic fluid. It is preferable that the third plug be a rigid plug that lands on a seat above the second zone of interest. As the third plug is advanced into the wellbore, it pushes at least a portion of the second fluid, which is preferably an acidic fluid, into the second zone of interest. Thus, the third plug may be referred to as a fluid displacement plug.

In the method 600, use of the first plug is optional. In this respect, the first volume of acidic fluid may be injected into the first zone of interest without use of a first plug separating the first volume of acidic fluid from wellbore fluids already in place. However, the use of the first plug is preferred in order to prevent fluid bypass.

As can be seen, the present inventions allow for the use of a quasi-mechanical plug that carries the benefits of a chemical diverter. In this respect, in at least some embodiments a wireline is not needed to set the plug, and the plug can never become permanently stuck in the wellbore. This removes the possibility of failure and subsequent fishing operations. At the same time, the quasi-mechanical plug improves the stimulation of upper zones in a multi-zone wellbore. In this way, each zone in a multi-zone wellbore enjoys a successful acid stimulation job, that is, all zones receive the desired amount of acid, at low cost with limited risk of mechanical failure. Further, the procedure reduces cost by allowing continuous pumping of the acid treatment.

While it will be apparent that the inventions herein described are well calculated to achieve the benefits and advantages set forth above, it will be appreciated that the inventions are susceptible to modification, variation and change without departing from the spirit thereof.

What is claimed is:

1. A method for stimulating a multi-zone wellbore, the multi-zone wellbore being completed with a string of production casing, and the method comprising:

pumping a first volume of acidic fluid into the wellbore comprising a first set of perforations in a first zone of interest and another set of perforations in a second zone of interest;

injecting the first volume of acidic fluid through the first set of perforations and into at least the first zone of interest along the production casing;

dropping a plug into the wellbore, the plug having a defined geometry and being fabricated from a material that dissolves in the presence of the acidic fluid at or over a selected period of time;

pumping a second volume of acidic fluid into the wellbore;

setting the plug along the production casing at least partially above the first zone of interest to inhibit the flow of the second volume of acidic fluid into the first zone of interest; and injecting the second volume of acidic fluid through the another set of perforations and into the second zone of interest along the production casing and above the first zone of interest.

2. The method of claim 1, wherein each of the volumes of acidic fluid comprises hydrochloric acid, acetic acid, formic acid, or combinations thereof.

3. The method of claim 1, wherein the material that dissolves in the presence of the acidic fluid comprises a carbonate material or an elastomeric material.

4. The method of claim 1, wherein the material that dissolves in the presence of the acidic fluid comprises carbonate, sodium bicarbonate, calcite rock, chalk rock, or combinations thereof.

5. The method of claim 1, wherein the material that dissolves in the presence of the acidic fluid also dissolves in the presence of brine.

6. The method of claim 1, wherein the material that dissolves in the presence of the acidic fluid is designed so as not to substantially dissolve until the second volume of acidic fluid has been injected into the second zone of interest.

7. The method of claim 6, wherein the material that dissolves in the presence of the acidic fluid does not significantly dissolve for about 5 minutes to 60 minutes after being exposed to the acidic fluid within the wellbore 8. The method of claim 6, wherein the plug is at least partially covered by a material that inhibits the reaction of the material that dissolves in the presence of the acidic fluid, thereby creating a delay in dissolution that is at least 5 minutes.

9. The method of claim 1, wherein the plug further comprises an elastomeric centralizing member for centralizing the plug in the production casing during pump-in, the elastomeric material also being fabricated from a material that dissolves in the presence of the acidic fluid.

10. The method of claim 1, wherein:

the plug comprises a substantially solid body having an outer diameter dimensioned to be received within the wellbore; and setting the plug in the wellbore above the first zone of interest comprises landing the plug on a seat along an inner diameter of the production casing at or above the first zone of interest.

11. The method of claim 10, wherein the seat comprises a reduced inner diameter portion of the casing for receiving the plug on the reduced inner diameter portion of the casing.

12. The method of claim 10, wherein the plug comprises a cylindrical body, a conical body, or a semi-spherical body.

13. The method of claim 12, wherein the plug is about 10.1 cm to 1.5 meters in length.

14. The method of claim 10, wherein the plug defines at least two separate plugs deployed in the wellbore together so as to increase the length of the plug over the seat.

15. The method of claim 1, wherein:

the plug comprises at least two substantially solid bodies, each having an outer diameter dimensioned to be received within the wellbore;

the plug is fabricated from a material that dissolves in the presence of the acidic fluid; and setting the plug in the wellbore above the first zone of interest comprises stacking the at least two substantially solid bodies from the bottom of the wellbore to substantially cover the first set of perforations located along the first zone of interest.

16. The method of claim 1, wherein the wellbore is completed to have either (i) a substantially vertical lower portion, or (ii) a lower portion that is deviated no more than 30 degrees from vertical.

17. The method of claim 16, wherein:

the plug comprises a viscous material forming a gelatinous cylindrical body having an outer diameter dimensioned to be received within the wellbore; and setting the plug in the wellbore comprises (i) pumping the plug to the first set of perforations located along the first zone of interest so that the gelatinous plug temporarily chokes the flow of the second volume of acidic fluid into the first set of perforations, thereby diverting the second volume of acidic fluid into the another set of perforations in the second zone of interest.

18. The method of claim 17, wherein the plug is about 0.61 meters to 10.0 meters in length.

19. The method of claim 18, wherein the plug defines at least two separate gelatinous plugs deployed in the wellbore together.

20. The method of claim 19, wherein the at least two plugs are stacked from a bottom of the wellbore.

21. The method of claim 1, wherein dropping the plug into the wellbore comprises manually placing the plug into the wellhead, and then pumping the plug down the production casing.

22. The method of claim 1, wherein dropping the plug into the wellbore comprises lowering the plug partially into the wellbore on a wireline, and releasing the plug from the wireline.

23. The method of claim 1, wherein the step of pumping the second volume of acidic fluid into the wellbore commences before the plug is dropped into the wellbore in order to increase pressure within the production casing.

24. The method of claim 1, further comprising:

dropping a previous plug into the wellbore before injecting the first volume of acidic fluid into the wellbore, the previous plug also having a defined geometry, and being fabricated from a material that dissolves in the presence of the acidic fluid over a selected period of time; and pumping the previous plug into the production casing below the first zone of interest substantially ahead of the first volume of acidic fluid.

25. The method of claim 1, further comprising:

dropping a subsequent plug into the wellbore, the subsequent plug also having a defined geometry, and being fabricated from a material that dissolves in the presence of the acidic fluid at or over a selected period of time;

pumping a third volume of acidic fluid into the wellbore under pressure;

setting the subsequent plug along the production casing at least partially above the second zone of interest; and injecting the third volume of acidic fluid into a third zone of interest along the production casing and above the second zone of interest.

26. A method for stimulating a multi-zone wellbore, the wellbore being completed with a string of production casing in a substantially vertical orientation, and the method comprising:

creating a first set of perforations in a first zone of interest and another set of perforations in a second zone of interest;

thereafter pumping a first volume of acidic fluid into the wellbore;

dropping a fluid diversion plug into the wellbore, the fluid diversion plug having a defined geometry, and being fabricated from a material that dissolves in the presence of the first volume of acidic fluid over a selected period of time;

pumping a second volume of acidic fluid into the wellbore in order to push the fluid diversion plug down the wellbore and to cause at least a portion of the first volume of acidic fluid to travel into the first zone of interest along the production casing;

setting the fluid diversion plug along the production casing above the first zone of interest to inhibit the flow of the second volume of acidic fluid into the first zone of interest;

injecting at least a portion of the second volume of acidic fluid into the second zone of interest along the production casing and above the fluid diversion plug before the fluid diversion plug substantially dissolves;

dropping a fluid displacement plug into the wellbore, the fluid displacement plug also having a defined geometry, and being fabricated from a material that dissolves in the presence of the second volume of acidic fluid over the selected period of time; and pumping a third volume of fluid into the wellbore in order to push the fluid displacement plug down the wellbore and to at least partially inject the second volume of acidic fluid into the second zone of interest above the first zone of interest.

27. The method of claim 26, wherein:

the third volume of fluid is a third volume of acidic fluid; and the method further comprises:

setting the fluid displacement plug along the production casing above the second zone of interest to inhibit the flow of the third volume of acidic fluid into the second zone of interest; and injecting at least a portion of the third volume of acidic fluid into the third zone of interest above the second zone of interest before the fluid displacement plug substantially dissolves.

28. The method of claim 27, wherein each of the volumes of acidic fluid comprises hydrochloric acid, acetic acid, formic acid, or combinations thereof.

29. The method of claim 27, wherein:

the fluid displacement plug comprises at least one substantially solid body; and setting the fluid displacement plug along the production casing comprises landing the fluid displacement plug on a seat within the production casing above the second zone of interest.

30. The method of claim 27, wherein:

the fluid displacement plug comprises at least one elongated gelatinous plug; and setting the fluid displacement plug along the production casing comprises landing the at least one elongated gelatinous plug on a bottom of the wellbore.

* * * * *